US006940338B2

(12) United States Patent
Kizaki et al.

(10) Patent No.: US 6,940,338 B2
(45) Date of Patent: Sep. 6, 2005

(54) SEMICONDUCTOR INTEGRATED CIRCUIT

(75) Inventors: Yoshihiro Kizaki, Kasugai (JP); Osamu Kudo, Kasugai (JP); Shinya Udo, Kasugai (JP); Toshihiko Kasai, Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/706,664

(22) Filed: Nov. 12, 2003

(65) Prior Publication Data

US 2004/0108889 A1 Jun. 10, 2004

(30) Foreign Application Priority Data

Dec. 5, 2002 (JP) ..... 2002-353941

(51) Int. Cl.[7] ..... G05F 1/10
(52) U.S. Cl. ..... 327/543
(58) Field of Search ..... 323/312, 313, 323/314, 315, 316; 327/538, 539, 540, 541, 543

(56) References Cited

U.S. PATENT DOCUMENTS 6,087,820 A * 7/2000 Houghton et al. ..... 323/315
6,570,436 B1 * 5/2003 Kronmueller et al. ..... 327/538

FOREIGN PATENT DOCUMENTS

| | | |
|---|---|---|
| JP | 2-097120 | 4/1990 |
| JP | 5-183356 | 7/1993 |

* cited by examiner

*Primary Examiner*—Jeffrey Zweizig
(74) *Attorney, Agent, or Firm*—Greer, Burns & Crain, Ltd

(57) ABSTRACT

A bias circuit generates a first voltage at a first node. A second current source generates, according to the first voltage, a power supply current to be supplied to an internal circuit including transistors. A correcting transistor in a correcting circuit supplies the first node with a correcting current generated according to a constant voltage. Because of this, the first voltage is adjusted according to the correcting current. Therefore, the operating speed of the internal circuit is prevented from changing, being dependent on the variation of the threshold voltage and temperature variation of a transistor. As a result, the yield can be improved, independently of the variation of the threshold voltage among semiconductor integrated circuit chips, which occurs in a fabrication process. Further, temperature dependency of the operating speed of the internal circuit can be reduced, which can improve the yield of the semiconductor integrated circuit.

8 Claims, 21 Drawing Sheets

Prior Art

Prior Art

Prior Art

SEMICONDUCTOR INTEGRATED CIRCUIT

CROSS-REFERENCE TO RELATED APPLICATIONS

This application is based upon and claims the benefit of priority from the prior Japanese Patent Application No. 2002-353941, filed on Dec. 5, 2002, the entire contents of which are incorporated herein by reference.

BACKGROUND OF THE INVENTION

1. Field of the Invention

The present invention relates to a semiconductor integrated circuit that has an internal circuit including transistors and a bias circuit for supplying a constant current to the internal circuit.

2. Description of the Related Art

FIG. 1 shows an example of a bias circuit in a prior art.

A bias circuit 100 has a band-gap reference BGR that generates a reference voltage V0, an amplifier AMP that receives the reference voltage V0, and a voltage generating unit VGEN that receives an output voltage of the amplifier AMP to generate predetermined voltages at nodes ND100, ND200. The voltage generating unit VGEN has a pMOS transistor PM100, an nMOS transistor NM100, and a resistor R100 that are connected in series between a power supply line VDD and a ground line VSS. The nMOS transistor NM100 receives the output voltage of the amplifier AMP at a gate thereof.

The node ND100 connected to a drain of the pMOS transistor PM100 is connected to gates of pMOS transistors PM200 (PM210, PM220, . . . ) constituting a constant-current source 200. The pMOS transistor PM100 in the bias circuit 100 and the pMOS transistors PM200 in the constant-current source 200 constitute current mirror circuits respectively. Drains of the pMOS transistors PM200 (PM210, MP220, . . . ) are connected to power supply lines of internal circuits 300 (300*a*, 300*b*, . . . )

In the bias circuit 100 described above, the band-gap reference BGR stably outputs a silicon band-gap voltage (approximately 1.2 V), independently of temperature variation and a threshold voltage of a transistor constituting the band-gap reference BGR. Therefore, a bias circuit of this type is capable of generating a constant current I10 without being influenced by temperature variation or the variation of conditions of a semiconductor integrated circuit fabrication process (for example, FIG. 1 in Japanese Unexamined Patent Application Publication No. Hei 5-183356).

FIG. 2 shows the operation of the internal circuits 300 connected to the bias circuit 100 shown in FIG. 1

Generally, current consumption of a transistor increases when the threshold voltage of the transistor becomes lower due to the change of process conditions and so on in a semiconductor integrated circuit fabrication process. Accordingly, the operating speed of the internal circuits 300 becomes faster. The operating speed of the internal circuits 300 becomes slower when the threshold voltage of a transistor becomes higher. Further, the current consumption of a transistor has temperature dependency. Accordingly, the operating speed of the internal circuits 300 changes also when the ambient temperature of the semiconductor integrated circuit varies.

The product specification (timing specification, current specification, and so on) of a semiconductor integrated circuit is determined in consideration of the aforesaid variation of the threshold voltage and temperature variation. Therefore, the timing specification, for example, of operating frequency or the like is determined according to the maximum value and the minimum value of the threshold voltage and-the maximum value and the minimum value of the temperature ((a) and (b) in FIG. 2).

FIG. 3 shows the distribution of the threshold voltage of a specific transistor for each semiconductor integrated circuit chip.

The threshold voltage of the transistors varies due to the variation of the process conditions (manufacturing lot) and so on. Therefore, the dispersion of the threshold voltage among manufactured semiconductor integrated circuit chips presents arc-formed distribution having its peak at the center, as shown in the drawing.

In the aforesaid semiconductor integrated circuit in the prior art, when the threshold voltage is in a lower range, the operating frequency does not satisfy the maximum rating in the product specification, resulting in a defective die. On the other hand, when the threshold voltage is in a higher range, the operating frequency does not satisfy the minimum rating in the product specification. As a result, a range satisfying the specification is narrowed, which lowers the yield that is the ratio of the number of good dies, resulting in product cost increase.

SUMMARY OF THE INVENTION

An object of the present invention is to keep the operating speed of an internal circuit constant even when conditions of fabrication process of a semiconductor integrated circuit varies.

Another object of the present invention is to keep the operating speed of an internal circuit constant even when the ambient temperature of a semiconductor integrated circuit varies.

Still another object of the present invention is to prevent yield reduction due to the change of characteristics of transistors constituting a semiconductor integrated circuit, to thereby reduce product cost.

According to one of the aspects of the semiconductor integrated circuit of the present invention, a bias circuit has a first current source that generates a first current and a load circuit connected in series with the first current source. The bias circuit generates a first voltage at a first node that is a connecting node between the first current source and the load circuit. A second current source generates, in accordance with the first voltage, a power supply current to be supplied to an internal circuit. The internal circuit has a plurality of first transistors that operate by the power supply current. A correcting circuit includes a correcting transistor that receives a constant voltage at a gate thereof. The correcting circuit generates, in accordance with the constant voltage, a correcting current at a second node electrically connected to a drain of the correcting transistor. The second node is electrically connected to the first node. A current equal to, for example, the sum of the first current generated by the first current source and the correcting current generated by the correcting circuit flows through the load circuit.

When the threshold voltage of a transistor lowers due to the variation of the process conditions and so on in the fabrication process of the semiconductor integrated circuit, the correcting current flowing through the correcting transistor in the correcting circuit increases. The increase in the correcting current causes the first current to decrease, and the first voltage to drop. The drop of the first voltage causes the power supply current to decrease. Therefore, the operating speed of the transistors in the internal circuit that becomes faster due to the drop of the threshold voltage is corrected by the decrease in the power supply current.

On the other hand, when the threshold voltage of a transistor becomes higher due to the change in the process conditions and so on in the fabrication process of the semiconductor integrated circuit, the correcting current flowing through the correcting transistor in the correcting circuit decreases. The decrease in the correcting current causes the first current to increase and the first voltage to rise. The rise of the first voltage causes the power supply current to increase. Therefore, the operating speed of the transistors in the internal circuit, which slows down due to the rise of the threshold voltage, is corrected by the increase in the power supply current.

Further, when the temperature of the semiconductor integrated circuit drops while the semiconductor integrated circuit is in operation, the correcting current flowing through the correcting transistor in the correcting circuit increases. Then, similarly to the above, the increase in the correcting current causes the power supply current to decrease. Therefore, the operating speed of the transistors in the internal circuit, which becomes faster due to the temperature drop, is corrected by the decrease in the power supply current. When the temperature of the semiconductor integrated circuit rises while the semiconductor integrated circuit is in operation, the correcting current flowing through the correcting transistor in the correcting circuit decreases. Then, similarly to the above, the decrease in the correcting current causes the power supply current to increase. Therefore, the operating speed of the transistors in the internal circuit, which slows down due to the temperature raise, is corrected by the increase in the power supply current.

Thus, the change in the operating speed of the internal circuit depending on the variation of the threshold voltage and the temperature variation of the transistor is prevented. In other words, the operating speed of the internal circuit is kept constant, irrespective of the variation of the threshold voltage and the temperature variation. Therefore, the yield of the semiconductor integrated circuit can be improved, independently of the variation of the threshold voltage among semiconductor integrated circuit chips, which occurs during the fabrication process. Further, since temperature dependency of the operating speed of the internal circuit can be reduced, the yield of the semiconductor integrated circuit can be improved. As a result, product cost of the semiconductor integrated circuit can be reduced.

According to another aspect of the semiconductor integrated circuit of the present invention, a bias circuit has a first current source that generates a first current and a load circuit connected in series with the first current source. The bias circuit generates a first voltage at a first node that is a connecting node between the first current source and the load circuit. A second current source generates, in accordance with the first voltage, a power supply current to be supplied to an internal circuit. The internal circuit has a plurality of first transistors that operate by the power supply current. A correcting circuit includes a correcting transistor that receives a constant voltage at a gate thereof. The correcting circuit generates, in accordance with the constant voltage, a correcting current at a second node electrically connected to a drain of the correcting transistor. The second node is connected to a connecting node between the second current source and the internal circuit. A current equal to, for example, the power supply current generated by the second current source from which the correcting current generated by the correcting circuit is subtracted flows through the internal circuit.

For example, when a semiconductor integrated circuit which has a low threshold voltage is fabricated, the correcting current increases similarly to the above. Therefore, the current, which is supplied to the internal circuit, out of the power supply current decreases. When a semiconductor integrated circuit which has a high threshold voltage is fabricated, the correcting current decreases similarly to the above. Therefore, the current, which is supplied to the internal circuit, out of the power supply current increases. The same applies to the temperature variation. Therefore, the operating speed of the internal circuit is kept constant, irrespective of the variation of the threshold voltage and the temperature variation. Therefore, the yield of the semiconductor integrated circuit can be improved, independently of the variation of the threshold voltage among semiconductor integrated circuit chips, which occurs during the fabrication process. Further, since temperature dependency of the operating speed of the internal circuit can be reduced, the yield of the semiconductor integrated circuit can be improved. As a result, product cost of the semiconductor integrated circuit can be reduced.

This invention can achieve an especially distinguished effect when being applied to a semiconductor integrated circuit having a plurality of second current sources connected to a common bias circuit and a plurality of internal circuits corresponding to these current sources. This is because it can be set for each internal circuit according to the kind (function) of the internal circuit whether or not a correcting circuit is to be connected thereto.

According to still another aspect of the semiconductor integrated circuit of the present invention, the bias circuit has a reference voltage generator that generates a constant reference voltage, independently of temperature variation and a variation of a threshold voltage. Specifically, the reference voltage generator has a threshold voltage compensating function for the variation of the threshold voltage of each of the first transistors formed in the internal circuit and a temperature compensating function for the temperature variation. The bias circuit generates the first voltage according to the reference voltage. At this time, the bias circuit generates the constant voltage, independently of the temperature variation and the variation of the threshold voltage, but the operating speed of the internal circuit varies depending on the temperature variation and the variation of the threshold voltage. Thus, the present invention can achieve a distinguished effect when being applied to a semiconductor integrated circuit having a bias circuit that generates a constant voltage, independently of the temperature variation and the variation of the threshold voltage.

According to yet another aspect of the semiconductor integrated circuit of the present invention, the correcting transistor is an nMOS transistor. Therefore, it is possible to keep the operating speed of the nMOS transistor formed in the internal circuit constant when the threshold voltage of the nMOS transistor varies. Or, it is also possible to keep the operating speed of the nMOS transistor constant when the temperature varies.

According to yet another aspect of the semiconductor integrated circuit of the present invention, the correcting transistor is a PMOS transistor. Therefore, it is possible to keep the operating speed of the PMOS transistor formed in the internal circuit constant when the threshold voltage of the pMOS transistor varies. Or, it is also possible to keep the operating speed of the pMOS transistor constant when the temperature varies.

According to yet another aspect of the semiconductor integrated circuit of the present invention, the first current source and the second current source have a third transistor and a fourth transistor respectively whose gates are connected to the first node. The third and the fourth transistors constitute a second current mirror circuit. This makes it possible to make the power supply current generated in the second current source equal to the current generated in the first current source. As a result, the power supply current supplied to the internal circuit is accurately adjusted under correction control by the correcting circuit.

According to yet another aspect of the semiconductor integrated circuit of the present invention, a drain of the correcting transistor is directly connected to the second node. This makes it possible to simplify the configuration of the correcting circuit, thereby minimizing the increase in chip size of the semiconductor integrated circuit.

According to yet another aspect of the semiconductor integrated circuit of the present invention, a bias circuit has a first current source that generates a first current and a load circuit connected in series with the first current source. The bias circuit generates a first voltage at a first node that is a connecting node between the first current source and the load circuit. A second current source generates, in accordance with the first voltage, a power supply current to be supplied to an internal circuit. The internal circuit has a plurality of first transistors that operate by the power supply current. A first correcting circuit includes a first correcting transistor that receives a first constant voltage at a gate thereof. The first correcting circuit generates, in accordance with the first constant voltage, a first correcting current at a second node electrically connected to a drain of the first correcting transistor. The second correcting circuit includes a second correcting transistor that receives a second constant voltage at a gate thereof and that has a reverse polarity to that of the first correcting transistor. The second correcting circuit generates, in accordance with the second constant voltage, a second correcting current at the second node electrically connected to a drain of the second correcting transistor. The second node is electrically connected to the first node. A current equal to, for example, the sum of the first current generated by the first current source and the first and the second correcting currents generated by the first and the second correcting circuits flows through the load circuit.

Also in this invention, similarly to the above, the operating speed of the internal circuit is kept constant, irrespective of the variation of the threshold voltage and the temperature variation. Therefore, the yield of the semiconductor integrated circuit can be improved, independently of the variation of the threshold voltage among semiconductor integrated circuit chips, which occurs during the fabrication process. Further, since temperature dependency of the operating speed of the internal circuit can be reduced, the yield of the semiconductor integrated circuit can be improved. As a result, product cost of the semiconductor integrated circuit can be reduced.

Further, the power supply current is adjusted according to the first and the second correcting transistors having reverse polarities to each other. This makes it possible to keep the operating speed of the internal circuit constant even when two kinds of transistors different in polarity are formed in the internal circuit.

According to yet another aspect of the semiconductor integrated circuit of the present invention, a bias circuit has a first current source that generates a first current and a load circuit connected in series with the first current source. The bias circuit generates a first voltage at a first node that is a connecting node between the first current source and the load circuit. A second current source generates, in accordance with the first voltage, a power supply current to be supplied to an internal circuit. The internal circuit has a plurality of first transistors that operate by the power supply current. A first correcting circuit includes a first correcting transistor that receives a first constant voltage at a gate thereof. The first correcting circuit generates, in accordance with the first constant voltage, a first correcting current at a second node electrically connected to a drain of the first correcting transistor. The second correcting circuit includes a second correcting transistor that receives a second constant voltage at a gate thereof and that has a reverse polarity to that of the first correcting transistor. The second correcting circuit generates, in accordance with the second constant voltage, a second correcting current at the second node electrically connected to a drain of the second correcting transistor. The second node is connected to a connecting node between the second current source and the internal circuit. A current equal to, for example, the power supply current generated by the second current source from which the first and the second correcting currents generated by the first and the second correcting circuits are subtracted flows through the internal circuit.

Also in this invention, similarly to the above, the operating speed of the internal circuit is kept constant, irrespective of the variation of the threshold voltage and the temperature variation. Therefore, the yield of the semiconductor integrated circuit can be improved, independently of the variation of the threshold voltage among semiconductor integrated circuit chips, which occurs during the fabrication process. Further, since temperature dependency of the operating speed of the internal circuit can be reduced, the yield of the semiconductor integrated circuit can be improved. As a result, product cost of the semiconductor integrated circuit can be reduced.

Further, the current supplied to the internal circuit is adjusted according to the first and the second correcting transistors that are different in polarity. This makes it possible to keep the operating speed of the internal circuit constant even when two kinds of transistors different in polarity are formed in the internal circuit.

According to yet another aspect of the semiconductor integrated circuit of the present invention, one of the first correcting transistor and the second correcting transistor is an nMOS transistor, and the other is a pMOS transistor. This makes it possible to keep the operating speed of the internal circuit constant even when the threshold voltages of the nMOS transistor and the pMOS transistor which are formed in the internal circuit change respectively.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

Hereinafter, embodiments of the present invention will be explained with reference to the drawings.

Figure 4:
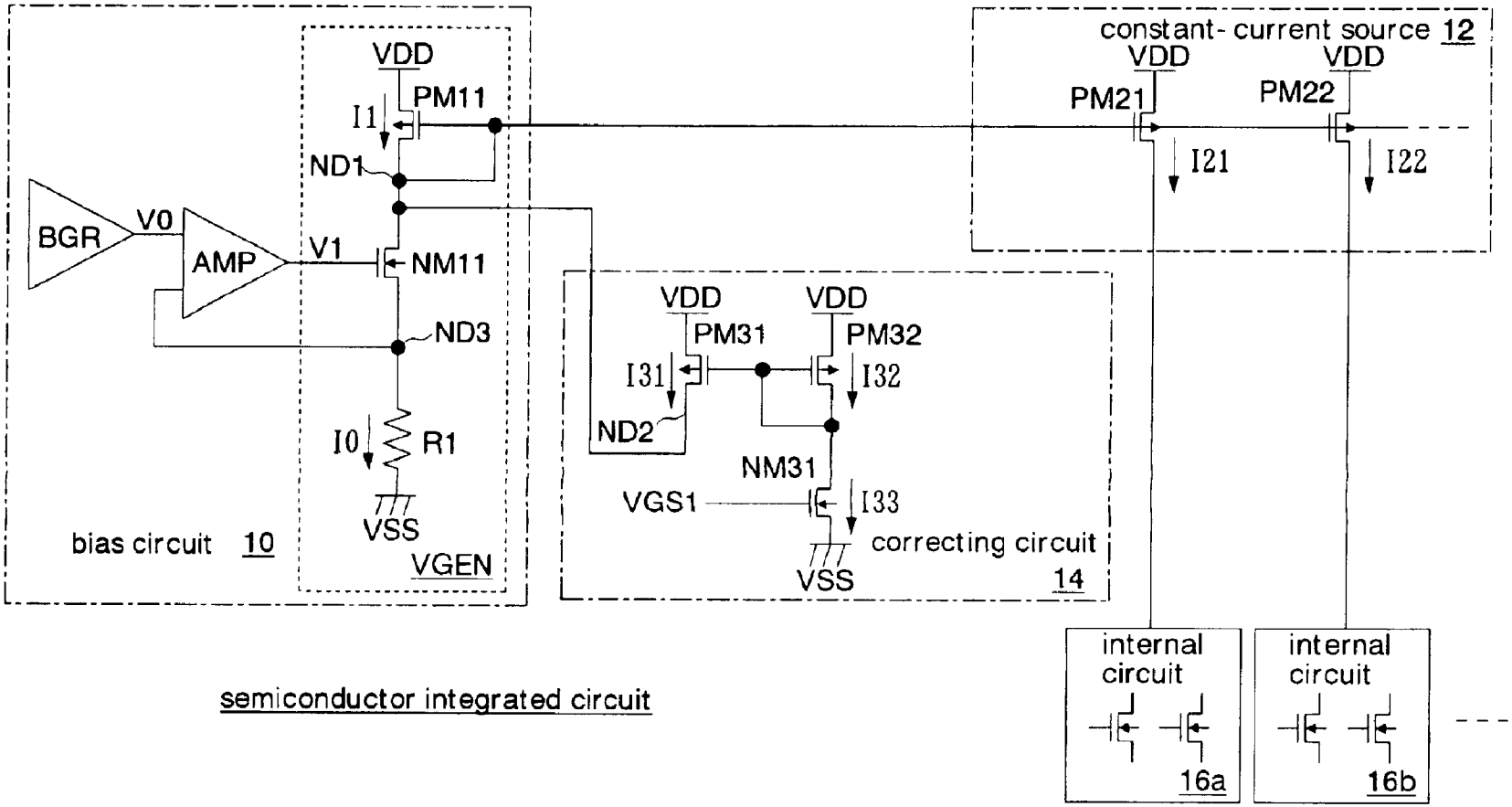
FIG. 4 is a circuit diagram showing a first embodiment of a semiconductor integrated circuit of the present invention.

FIG. 4 shows a first embodiment of a semiconductor integrated circuit of the present invention. Semiconductor integrated circuit chip is formed on a silicon substrate as, for example, LCD driver, using a CMOS process.

The semiconductor integrated circuit has a bias circuit 10, a constant-current source 12, a correcting circuit 14, and internal circuits 16 (16*a*, 16*b*, . . . ).

The bias circuit 10 has a band-gap reference BGR (reference voltage generator), an amplifier AMP, and a voltage generating unit VGEN. The band-gap reference BGR, which is constituted of a well-known CMOS circuit, generates a reference voltage V0 (approximately 1.2 V; more precisely, 1.205 V) that is a voltage of a silicon band-gap. The reference voltage V0 is independent of the variation of the ambient temperature of the semiconductor integrated circuit, and kept at a constant value. The reference voltage V0 is also kept at a constant value when the threshold voltage of a transistor varies in accordance with the change of process conditions in a semiconductor integrated circuit fabrication process. In other words, the band-gap reference BGR has a temperature compensating function and a threshold voltage compensating function.

The amplifier AMP operates in accordance with the reference voltage V0 and a feedback from the voltage generating unit VGEN to output a constant voltage V1.

The voltage generating unit VGEN has a pMOS transistor PM11 (first current source, third transistor), an nMOS transistor NM11, and a resistor R1 (load circuit) that are connected in series between a power supply line VDD and a ground line VSS. A gate of the pMOS transistor PM11 is connected to a drain (first node ND1). A gate of the nMOS transistor NM11 receives the constant voltage V1. A connecting node ND3 between the nMOS transistor NM11 and the resistor R1 is connected to one input of the amplifier AMP. The voltage of the connecting node ND3 is independent of the temperature variation and the variation of the threshold voltage, and is kept at 1.2 V based on the feedback from the connecting node ND3 to the amplifier AMP. Consequently, a predetermined voltage (first voltage) is generated at the first node ND1.

The constant-current source 12 has a plurality of pMOS transistors PM2 (PM21, PM22, . . . ; second current source, fourth transistor). The pMOS transistors PM2 are connected to power supply lines VDD at sources thereof, and connected to the node ND1 at gates thereof. Drains of the pMOS transistors PM2 are connected to the internal circuits 16*a*, 16*b*, . . . , respectively.

The pMOS transistors PM2 of the constant-current source 12 and the pMOS transistor PM11 of the bias circuit 10 constitute current mirror circuits (second current mirror circuit) respectively. Consequently, a drain-to-source current I1 (first current) of the pMOS transistor PM11 becomes equal to each of source-to-drain currents I2 (I21, I22, . . . ; power supply current) of the pMOS transistors PM2. Therefore, each of the currents I21, I22, . . . supplied to the internal circuits 16*a*, 16*b*, . . . , becomes equal to the current I1 flowing through the bias circuit 10.

The correcting circuit 14 has pMOS transistors PM31, PM32 (second transistor) that constitute a current mirror circuit (first current mirror circuit) and an nMOS transistor NM31 (correcting transistor). Sources of the pMOS transistors PM31, PM32 are connected to the power supply lines VDD. Gates of the pMOS transistors PM31, PM32 are connected to a drain of the pMOS transistor PM32. A drain (second node ND2) of the pMOS transistor PM31 is connected to the first node ND1. A drain of the nMOS transistor NM31 is connected to the drain of the pMOS transistor PM32, a gate thereof is connected to a constant voltage line VGS1, and a source thereof is connected to a ground line VSS.

A drain-to-source current I33 (correcting current) flows through the nMOS transistor NM31 according to the gate voltage VGS1 that is a constant voltage. A drain-to-source current I32 equal to the current I33 flows through the pMOS transistor PM32. Therefore, a drain-to-source current I31 equal to the current I32 flows through the pMOS transistor PM31. The current I31 flows toward the node ND1 in the bias circuit 10. Accordingly, a current I0 flowing through the resistor R1 in the voltage generator VGEN in the bias circuit 10 is equal to the sum of the current I1 and the current I31 as expressed by the equation (1). Further, the current I0 has a constant value represented by the voltage (1.2 V) of the node ND3 and a resistance value of the resistor R1, as expressed by the equation (2). The current I31 can be expressed by the equation (3), where Vth is the threshold voltage of the nMOS transistor NM31.

$$I0=I1+I31 \quad (1)$$

$$I0=1.2/R1 \quad (2)$$

$$I31=\beta(VGS1-Vth)^2 \quad (3)$$

Each of the internal circuits 16 has a plurality of CMOS circuits including a pMOS transistor and an nMOS transistor. The internal circuits 16 form operational amplifiers of LCD driver. In other words, the internal circuits 16 operate as CMOS analog circuits.

Figure 5:
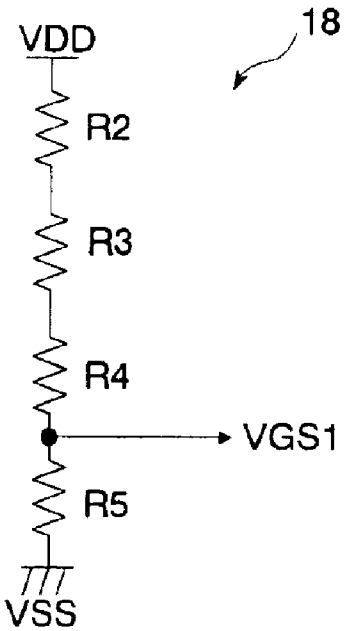
FIG. 5 is a circuit diagram showing a voltage generator for generating a constant voltage to be supplied to a correcting circuit shown in FIG. 4.

FIG. 5 shows a voltage generator 18 that generates the constant voltage VGS1 supplied to the gate of the nMOS transistor NM31 in the correcting circuit 14 shown in FIG. 4.

The voltage generator 18 has resistors R2, R3, R4, and R5 connected in series between the power supply line VDD and the ground line VSS. The constant voltage VGS1 is generated from a connecting node between the resistors R4, R5. A value of the constant voltage VGS1 is determined by the ratio of resistance values of the resistors R2 to R5. Therefore, the constant voltage VGS1 does not change due to the variation of the process conditions in the semiconductor integrated circuit fabrication process or due to temperature variation while the semiconductor integrated circuit is in operation.

Figure 6:
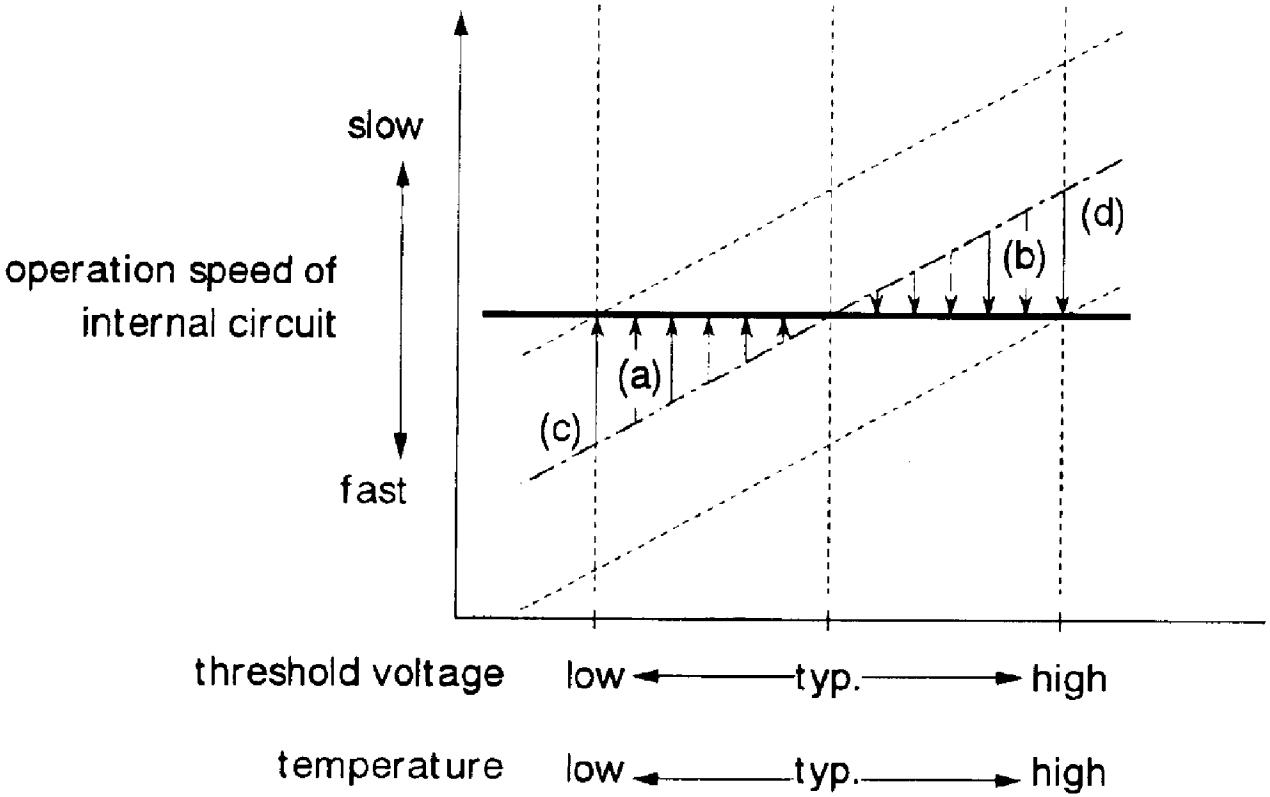
FIG. 6 is a characteristic chart showing the operation of an internal circuit in the present invention.

FIG. 6 shows the operation of the internal circuits 16 in the present invention. The heavy line in the drawing shows a characteristic when the present invention is applied and the dashed line shows a characteristic of a prior art.

In this invention, when the threshold voltage of a transistor formed in the semiconductor integrated circuit becomes lower than a typical value due to the variation of the process conditions in the semiconductor integrated circuit fabrication process, the threshold voltage of the nMOS transistor NM31 in the correcting circuit 14 shown in FIG. 4 also lowers. Since the voltage generator 18 shown in FIG. 5 is constituted of the diffused resistors R2, R3, R4, R5, the constant voltage VGS1 is kept constant even when the threshold voltage varies. Therefore, the drain-to-source current I33 of the nMOS transistor NM31 increases due to the drop in the threshold voltage as shown by the equation (3). As a result, the drain-to-source currents I32, I31 of the pMOS transistors PM32, PM31 also increase.

The bias circuit 10 shown in FIG. 4 generates the constant voltage (1.2 V) at the node ND3, independently of the variation of the threshold voltage. The current I0 flowing through the resistor R1 is not dependent on the variation of the threshold voltage but is kept constant as shown by the equation (2). Therefore, the current I1 decreases due to the increase in the current I31 as shown by the equation (1). There occurs a decrease in the power supply currents I21, I22 respectively supplied to the internal circuits 16 by the pMOS transistors PM21, PM22 in the constant-current source 12. Accordingly, the operating speed of the internal circuits 16 becomes slower ((a) in FIG. 6). As a result, the operating speed of the internal circuits 16 becomes substantially equal to that when the threshold voltage has the typical value. In other words, the threshold voltage dependency of the operating speed is eliminated by applying the present invention.

On the other hand, when the threshold voltage of a transistor formed in the semiconductor integrated circuit exceeds the typical value due to the variation of the process conditions in the semiconductor integrated circuit fabrication process, the threshold voltage of the nMOS transistor NM31 in the correcting circuit 14 increases, contrary to the above, and the drain-to-source current I33 of the nMOS transistor NM31 decreases as shown by the equation (3). As a result, the drain-to-source currents I32, I31 of the pMOS transistors PM32, PM31 also decrease. Accordingly, the current I1 increases due to the decrease in the current I31, as shown by the equation (1). There occurs an increase in the power supply currents I21, I22 respectively supplied to the internal circuits 16 by the PMOS transistors PM21, PM22 in the constant-current source 12. Consequently, the operating speed of the internal circuits 16 becomes faster ((b) in FIG. 6). As a result, the operating speed of the internal circuits 16 becomes substantially equal to that when the threshold voltage has the typical value. In other words, threshold voltage dependency of the operating speed is eliminated by applying the present invention.

Note that, when the ambient temperature drops while the semiconductor integrated circuit is in operation, the drain-to-source current I33 of the nMOS transistor NM31 in the correcting circuit 14 increases, similarly to the case when the threshold voltage drops. Accordingly, the operating speed of the internal circuits 16 becomes faster. On the other hand, when the ambient temperature rises while the semiconductor integrated circuit is in operation, the drain-to-source current I33 of the MOS transistor NM31 decreases, similarly to the case when the threshold voltage increases. Accordingly, the operating speed of the internal circuits 16 becomes slower. As a result, the fluctuation of the operating speed of the internal circuits 16 due to the temperature variation is prevented by applying the present invention.

On the other hand, in the prior art, the bias circuit 100 always generates a constant voltage at the node ND100 regardless of the threshold voltage of transistors. Consequently, the constant-current source 200 always outputs the constant power supply currents I210, I220 not dependent on the threshold voltage. Accordingly, when the threshold voltage of a transistor lowers, the operating speed of the internal circuits 300 becomes faster ((c) in FIG. 6). Contrary to this, when the threshold voltage of a transistor becomes higher, the operating speed of the internal circuits 300 becomes slower ((d) in FIG. 6).

Figure 7:
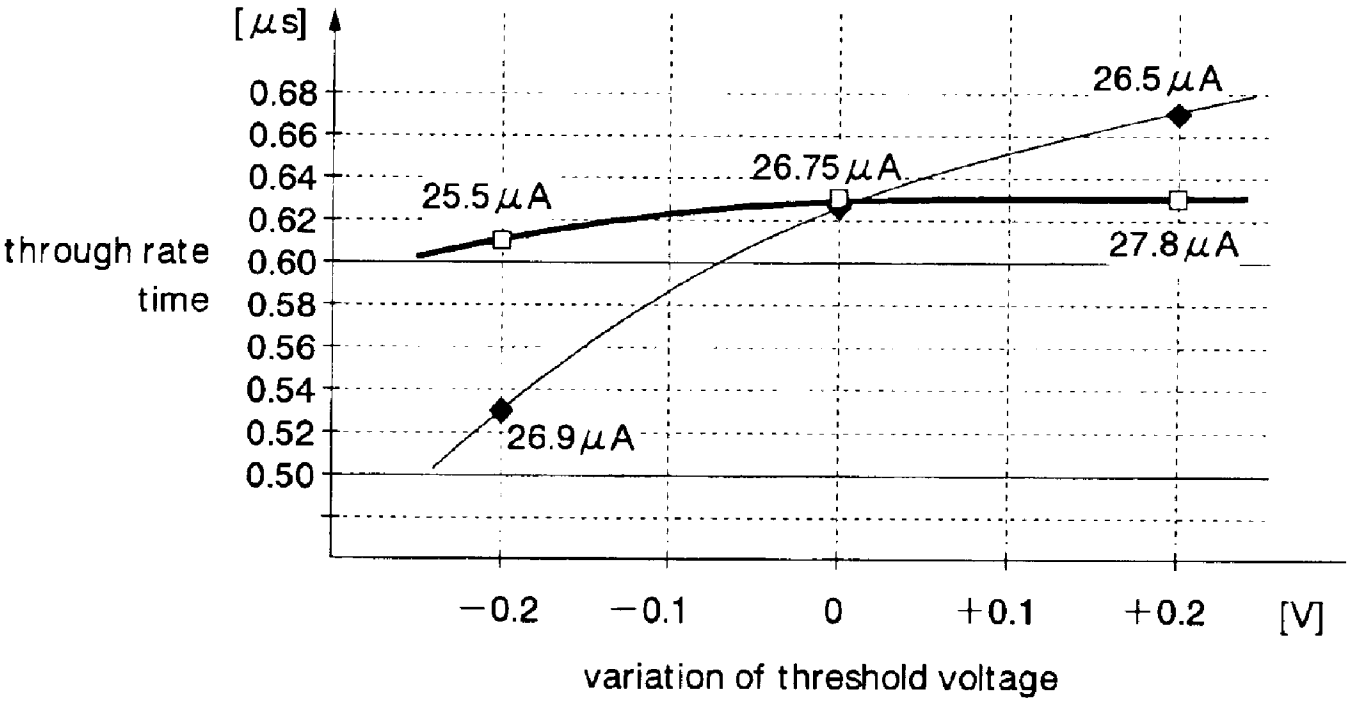
FIG. 7 is a characteristic chart showing a simulation result of the internal circuit in the first embodiment.

FIG. 7 shows a simulation result of the internal circuits 16 in a first embodiment.

Here, evaluation is made on a through rate time with the threshold voltage of a transistor (middle withstand voltage) of the operational amplifier formed in the internal circuit 16 being varied. Here, the through rate time is the time for an output signal of the operational amplifier to reach a desired voltage after it starts changing in response to an input signal. The operational amplifier is designed through the use of a semiconductor CMOS technology of 0.50 $\mu$m, and an input and a current source thereof are constituted of nMOS transistors. A power supply voltage of 10 V is supplied to the operational amplifier.

When the correcting circuit 14 having the nMOS transistor NM31 that receives the constant voltage VGS1 at its gate is formed in the semiconductor integrated circuit, the through rate time is not dependent on the variation of the threshold voltage, but is kept substantially constant, as shown by the white square marks in the drawing. On the other hand, in the prior art in which the correcting circuit 14 is not formed in the semiconductor integrated circuit, the through rate time changes, being dependent on the threshold voltage, as shown by the black rhombic marks in the drawing.

Thus, it has been confirmed also by the simulation that the operating speed of the internal circuit 16 is prevented from changing by applying the present invention, similarly to the characteristic shown in FIG. 6, even with the variation of the threshold voltage of the transistors constituting the internal circuits 16.

Figure 8:
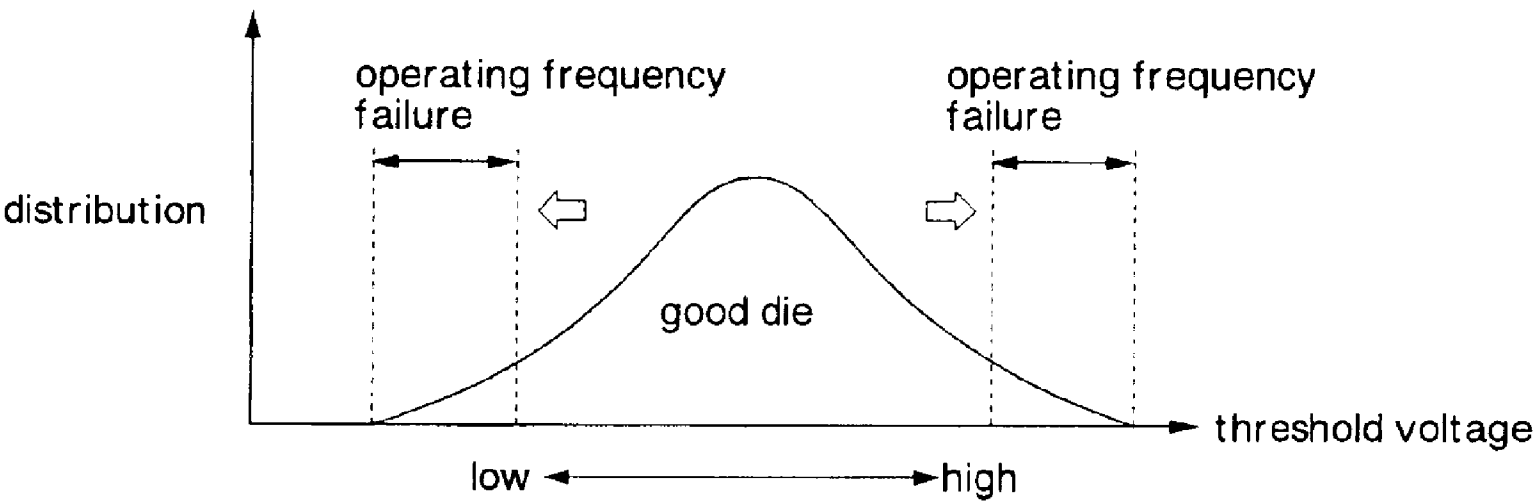
FIG. 8 is a characteristic chart showing the distribution of the threshold voltage of a specific transistor for each semiconductor integrated circuit chip.

FIG. 8 shows the distribution of the threshold voltage of a specific transistor for each semiconductor integrated circuit chip in the present invention.

Figure 1:
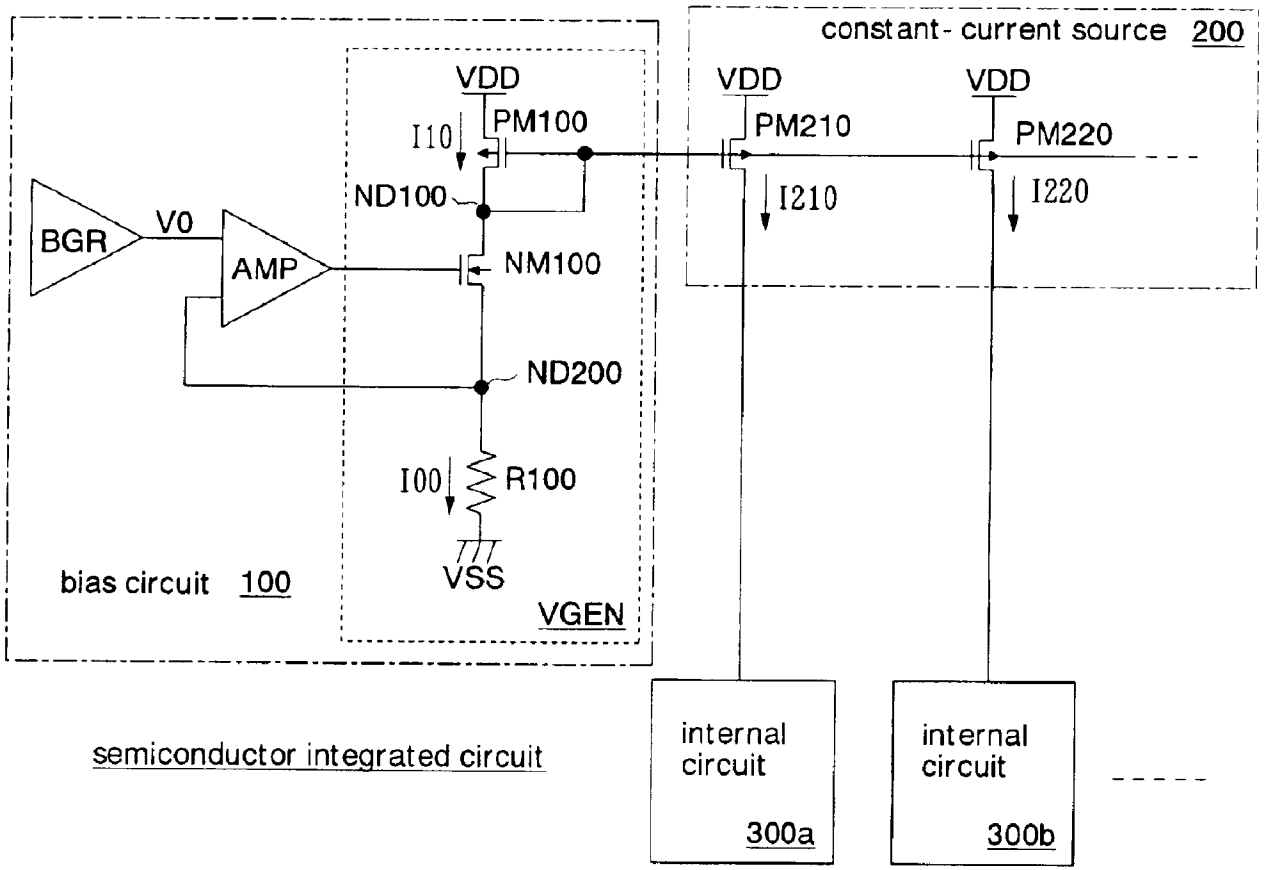
FIG. 1 is a circuit diagram showing one example of a bias circuit in a prior art.
Figure 2:
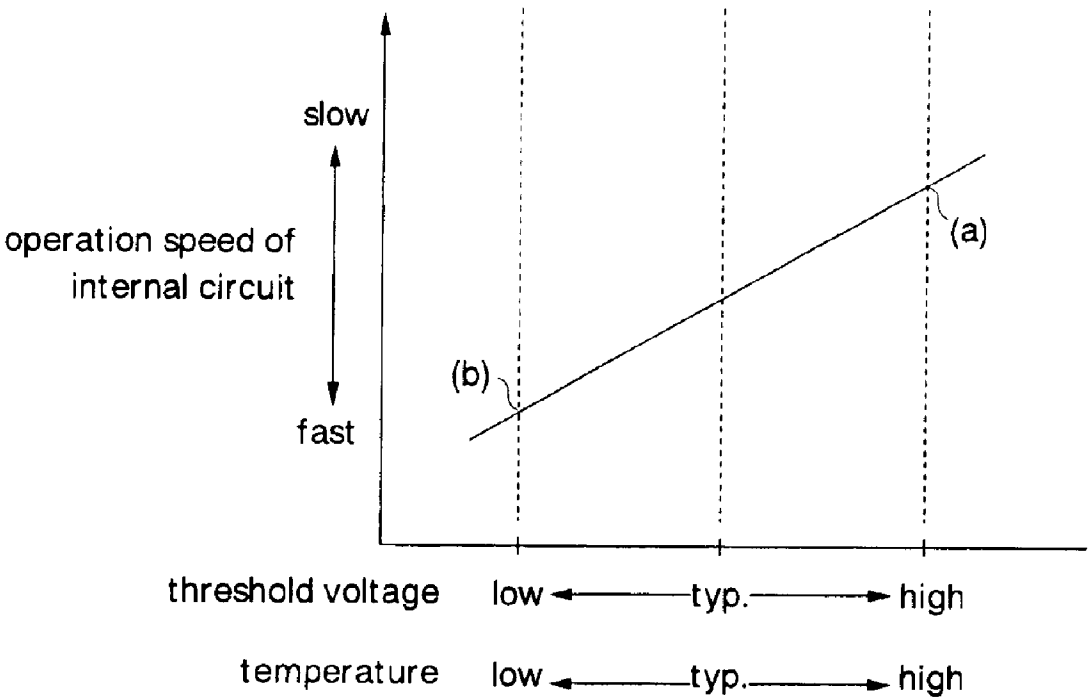
FIG. 2 is a characteristic chart showing the operation of an internal circuit 300 connected to a bias circuit 100 shown in FIG. 1.
Figure 3:
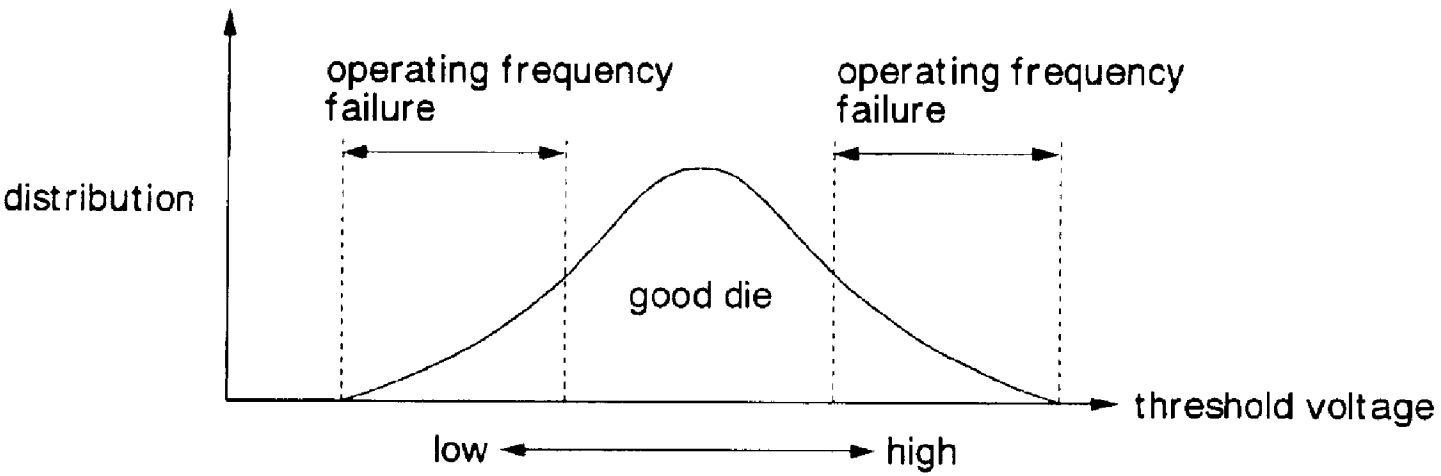
FIG. 3 is a characteristic chart showing the distribution of a threshold voltage of a specific transistor for each semiconductor integrated circuit chip in the prior art.

As described above, applying the present invention to the semiconductor integrated circuit allows the operating speed of the internal circuits to be independent of the threshold voltage, so that the operating speed is kept constant and current consumption is kept constant as well. This widens the range satisfying the standard, compared with the prior art even when the distribution of the threshold voltage is the same as in the prior art (FIG. 3), so that the yield that is the ratio of the number of good dies is improved. As a result, fabrication cost of the semiconductor integrated circuit is reduced.

In the above-described first embodiment, the output of the correcting circuit 14 is connected to the node ND1 in the bias circuit 10, so that the current equal to the sum of the current I1 and the current I31 flows through the resistor R1. This makes it possible to vary the power supply currents I2 to be supplied to the internal circuits 16, in accordance with the variation of the process conditions and so on during the semiconductor integrated circuit fabrication process and in accordance with temperature variation of the semiconductor integrated circuit while it is in operation. Consequently, the operating speed of the internal circuits can be kept constant, being independent of the variation of the threshold voltage and the temperature variation. As a result, the yield of the semiconductor integrated circuit can be improved to reduce product cost of the semiconductor integrated circuit.

The present invention is effective when being applied to a bias circuit in which a band-gap reference BGR is formed as a reference voltage generator. This is because the correcting circuit 14 can correct the constant voltage outputted from the reference voltage generator, which is independent of the temperature variation and the variation of the threshold voltage.

The correcting circuit 14 has the nMOS transistor NM31 that receives the constant voltage VGS1 at its gate, so as to be compatible to the operational amplifiers (internal circuits 16) whose input circuits and current sources are constituted of nMOS transistors. This makes it possible to keep the operating speed of the operational amplifiers substantially constant even when the threshold voltage of the nMOS transistors constituting the operational amplifiers varies. Or, this makes it possible to keep the operating speed of the operational amplifiers constant also when the temperature varies.

The current mirror circuits are constituted of the pMOS transistor PM11 in the bias circuit 10 and the pMOS transistors PM2 in the constant-current source 12. This makes it possible to make each of the power supply currents I2 generated in the constant-current source 12 equal to the current I1 generated in the bias circuit 10. As a result, accurate adjustment of the power supply currents I2 supplied to the internal circuits 16 is enabled by correction control by the correcting circuit 14.

Figure 9:
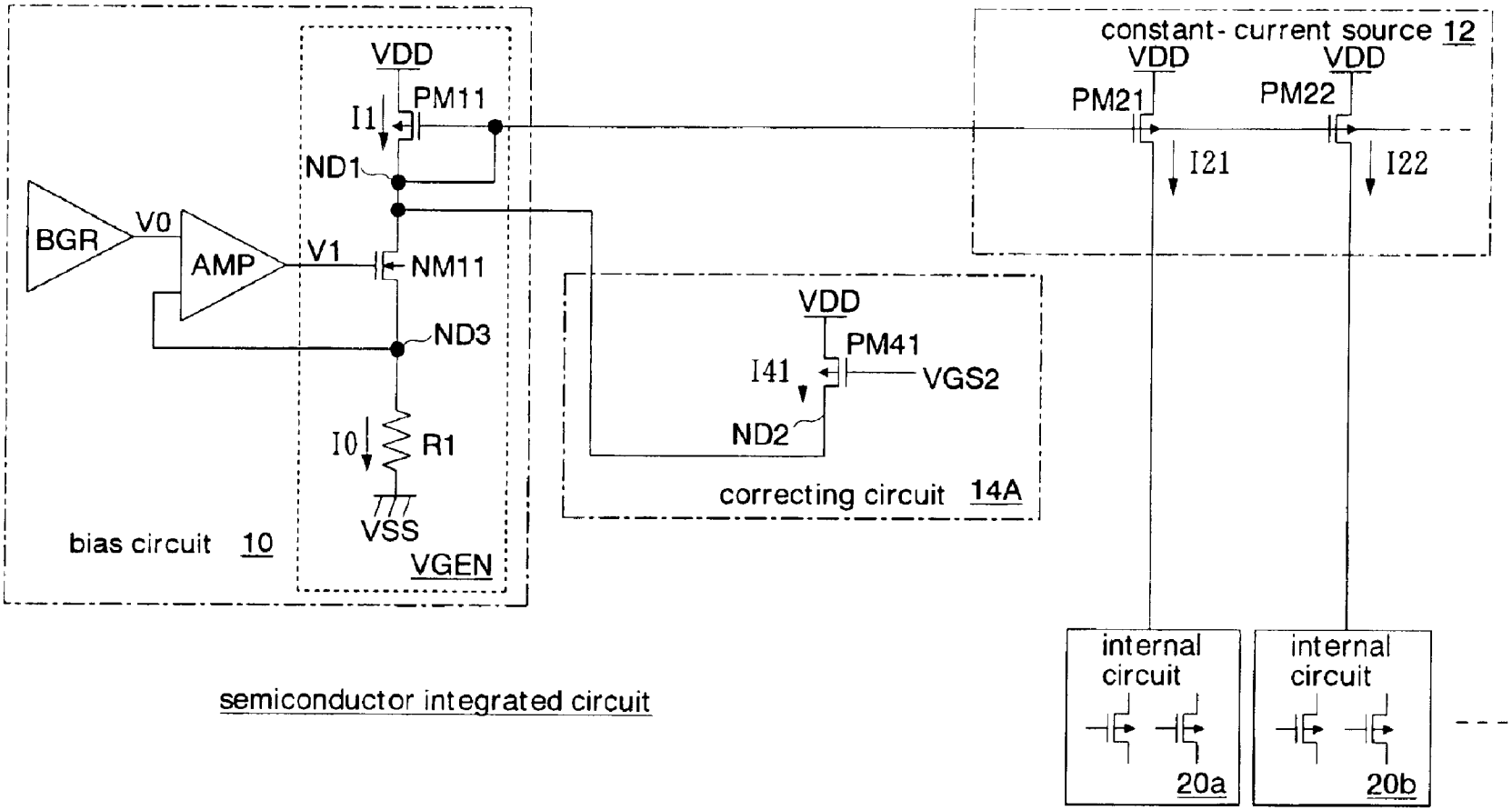
FIG. 9 is a circuit diagram showing a second embodiment of the semiconductor integrated circuit of the present invention.

FIG. 9 shows a second embodiment of the semiconductor integrated circuit of the present invention. The same reference numerals and symbols are used to designate the same components as those explained in the first embodiment, and detailed explanation thereof will be omitted.

In this embodiment, a correcting circuit 14A and internal circuits 20 (20*a*, 20*b*, . . . ) are formed instead of the correcting circuit 14 and the internal circuits 16 (16*a*, 16*b*, . . . ) of the first embodiment. Semiconductor integrated circuit chip is formed on a silicon substrate as, for example, LCD driver, using a CMOS process. The internal circuits 20 are formed as operational amplifiers of the LCD driver. The operational amplifiers have inputs and current sources both constituted of pMOS transistors. The other configuration is the same as that of the first embodiment.

The correcting circuit 14A is constituted of a pMOS transistor PM41 (correcting transistor). The pMOS transistor PM41 is connected to a power supply line VDD at its source, is connected to a constant voltage line VGS2 at its gate, and is connected to a node ND1 of a bias circuit 10 at a node ND2 being a drain thereof.

Figure 10:
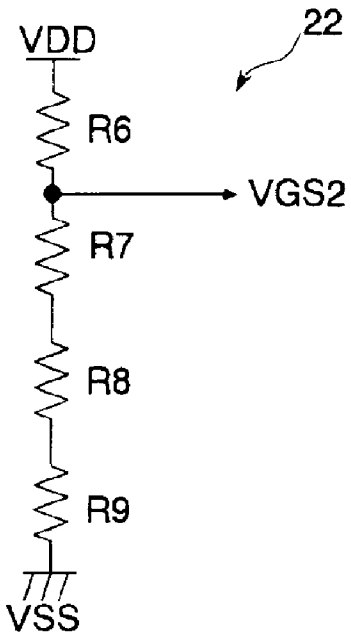
FIG. 10 is a circuit diagram showing a voltage generator for generating a constant voltage to be supplied to a correcting circuit shown in FIG. 9.

FIG. 10 shows a voltage generator 22 that generates a constant voltage VGS2 to be supplied to the gate of the pMOS transistor PM41 in the correcting circuit 14A shown in FIG. 9.

The voltage generator 22 has resistors R6, R7, R8, and R9 connected in series between a power supply line VDD and a ground line VSS. The constant voltage VGS2 is generated from a connecting node between the resistors R6, R7. A value of the constant voltage VGS2 is determined by the ratio of resistance values of the resistors R6 to R9. Therefore, the constant voltage VGS2 does not vary due to the change of the process conditions in the semiconductor integrated circuit fabrication process or due to temperature variation while the semiconductor integrated circuit is in operation.

In this embodiment, similarly to the first embodiment, when the threshold voltage of a transistor formed in the semiconductor integrated circuit becomes lower than a typical value, or when the ambient temperature drops while the semiconductor integrated circuit is in operation, a current I41 of the pMOS transistor PM41 in the correcting circuit 14A increases, so that power supply currents I21, I22 of the constant-current source 12 decrease. Consequently, the operating speed of the internal circuits 20 becomes slower to reduce current consumption. As a result, the operating speed and current consumption of the internal circuits 20 are made substantially equal to those when the threshold voltage has the typical value and when the temperature has a typical value, respectively.

When the threshold voltage of a transistor formed in the semiconductor integrated circuit exceeds the typical value, or when the ambient temperature rises while the semiconductor integrated circuit is in operation, the current I41 of the pMOS transistor PM41 in the correcting circuit 14A decreases, so that the power supply currents I21, I22, . . . of the constant-current source 12 increase. Consequently, the operating speed of the internal circuits 20 becomes faster, resulting in the increase in the current consumption. As a result, the operating speed and current consumption of the internal circuits 20 are made substantially equal to those when the threshold voltage has the typical value and when the temperature has the typical value, respectively.

The same effects as those in the aforesaid first embodiment can be obtained also in this embodiment. Further, the drain of the pMOS transistor PM41 is directly connected to the first node ND1 via the second node ND2 in this embodiment. This enables direct supply of the drain-to-source current I41 of the pMOS transistor PM41 to the node ND1. As a result, the response of a voltage generator VGEN to the operation of the correcting circuit 14A can be made quick. Further, the configuration of the correcting circuit 14A can be simplified to minimize the increase in chip size of the semiconductor integrated circuit.

Figure 11:
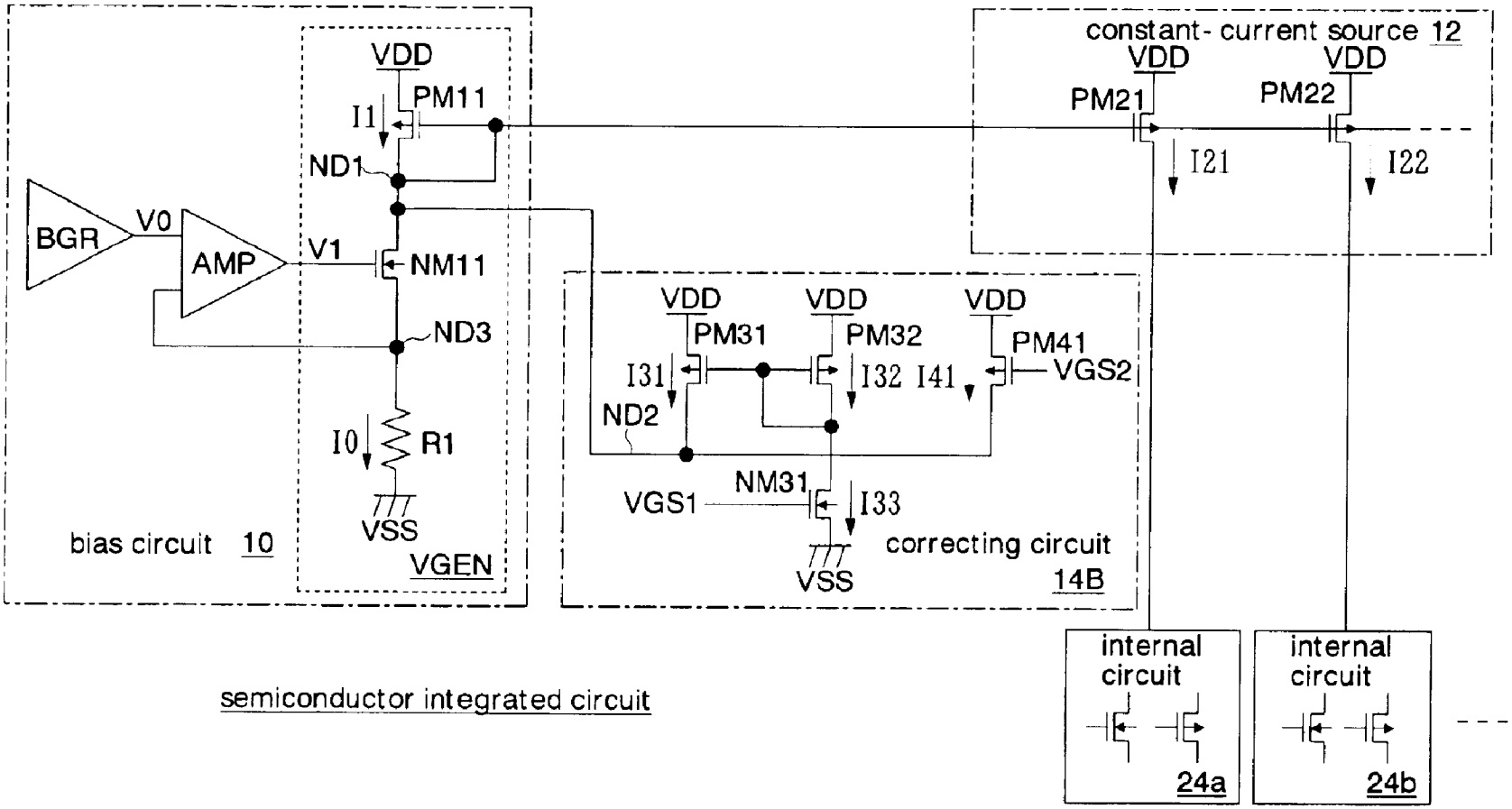
FIG. 11 is a circuit diagram showing a third embodiment of the semiconductor integrated circuit of the present invention.

FIG. 11 shows a third embodiment of the semiconductor integrated circuit of the present invention. The same reference numerals and symbols are used to designate the same components as those explained in the first embodiment, and detailed explanation thereof will be omitted.

In this embodiment, a correcting circuit 148 and internal circuits 24 (24*a*, 24*b*, . . . ) are formed instead of the correcting circuit 14 and the internal circuits 16 (16*a*, 16*b*, . . . ) of the first embodiment. Semiconductor integrated circuit chip is formed on a silicon substrate as, for example, LCD driver, using a CMOS process. The internal circuits 24 are formed as operational amplifiers of the LCD driver. The operational amplifiers are constituted of nMOS transistors and pMOS transistors. The other configuration is the same as that of the first embodiment.

The correcting circuit 14B is constituted of the combination of the correcting circuit 14 of the first embodiment and the correcting circuit 14A of the second embodiment. Specifically, a drain of an nMOS transistor NM31 and a drain of a pMOS transistor PM41 are connected to a second node ND2. A current I31 corresponding to a current I33 of the nMOS transistor NM31, and a current I41 of a pMOS transistor PM41 are supplied to the node ND1.

Figure 12:
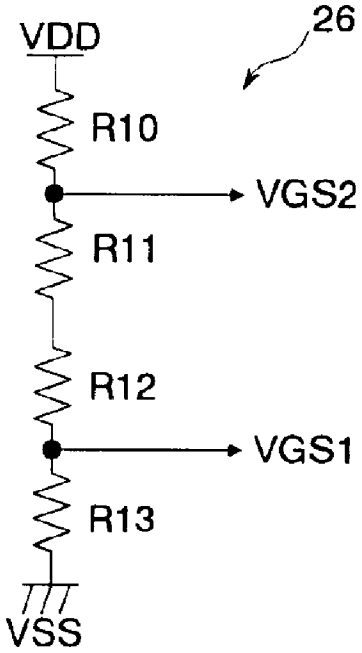
FIG. 12 is a circuit diagram showing a voltage generator for generating a constant voltage to be supplied to a correcting circuit shown in FIG. 11.

FIG. 12 shows a voltage generator 26 that generates a constant voltage VGS1 to be supplied to a gate of the nMOS transistor NM31 and a constant voltage VGS2 to be supplied to a gate of the pMOS transistor PM41 in the correcting circuit 14B shown in FIG. 11.

The voltage generator 26 has resistors R10, R11, R12, R13 that are connected in series between a power supply line VDD and a ground line VSS. The constant voltage VGS1 is generated from a connecting node between the resistors R12, R13. The constant voltage VGS2 is generated from a connecting node between the resistors R10, R11. Values of the constant voltages VGS1, VGS2 are determined by the ratio of resistance values of the resistors R10 to R13. Therefore, the constant voltages VGS1, VGS2 do not vary due to the change of the process conditions in a semiconductor integrated circuit fabrication process or due to temperature variation while the semiconductor integrated circuit is in operation.

The same effects as those of the aforesaid first and second embodiments can be obtained also in this embodiment. Further, in this embodiment, power supply currents I2 (I21, I22, . . . ) outputted by a constant-current source 12 are adjusted according to the pMOS transistor PM41 and the nMOS transistor NM31 that are different in polarity. Therefore, the operating speed of the internal circuits 24 can be kept constant even when circuits determining the operating speed are formed of pMOS transistors and nMOS transistors in the internal circuits 24.

Figure 13:
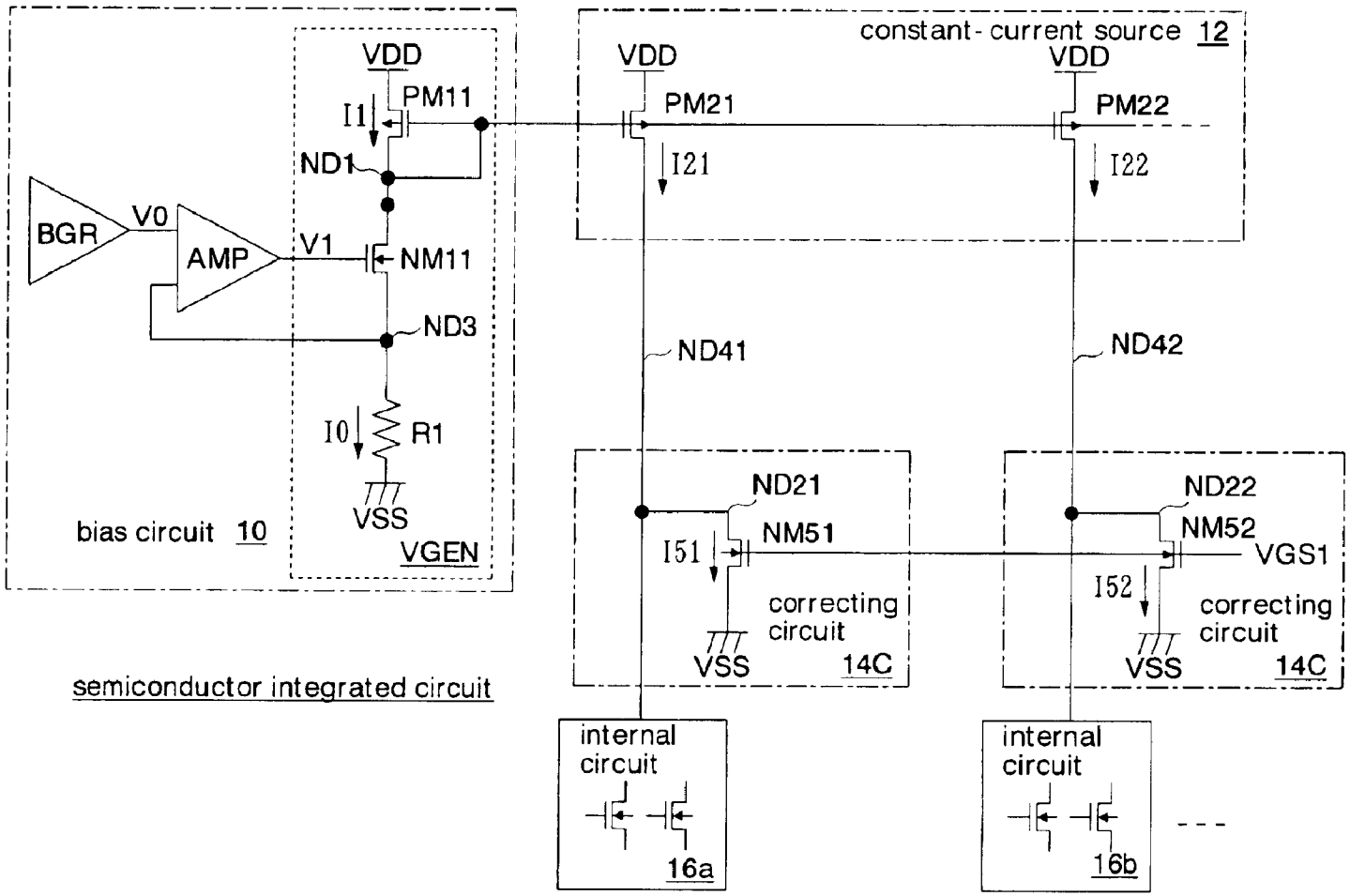
FIG. 13 is a circuit diagram showing a fourth embodiment of the semiconductor integrated circuit of the present invention.

FIG. 13 shows a fourth embodiment of the semiconductor integrated circuit of the present invention. The same reference numerals and symbols are used to designate the same components as those explained in the first embodiment, and detailed explanation thereof will be omitted.

In this embodiment, a plurality of correcting circuits 14C are connected not to a bias circuit 10 but to connecting nodes ND4 (ND41, ND42, . . . ) between a constant-current source 12 and internal circuits 16 (16*a*, 16*b*, . . . ). The other configuration is the same as that of the first embodiment.

The correcting circuits 14C are constituted of nMOS transistors NM5 (NM51, NM52, . . . ; correcting transistor) respectively. The nMOS transistors NM5 are connected to ground lines VSS at sources thereof, are connected to a constant voltage line VGS1 at gates thereof, and are connected to the nodes ND4 (ND41, ND42, . . . ) at second nodes ND2 (ND21, ND22, . . . ) being drains thereof.

In this embodiment, power supply currents I2 (I21, I22, . . . ) outputted from the constant-current source 12 partly flow to the ground lines VSS as drain-to-source currents I5 (I51, I52, . . . ; correcting current) of the nMOS transistors NM5 (NM51, NM52, . . . ). Therefore, currents equal to the power supply currents I2 from which the currents I5 are subtracted flow to the internal circuits 16 (16*a*, 16*b*, . . . ).

When the threshold voltage of a transistor formed in the semiconductor integrated circuit becomes lower than a typical value, or when the ambient temperature drops while the semiconductor integrated circuit is in operation, the currents I5 of the nMOS transistors NM5 in the correcting circuits 14C increase, so that currents supplied to the internal circuits 16 decrease. Therefore, the operating speed of the internal circuits 16 slows down, resulting in the reduction in current consumption. As a result, the operating speed and the current consumption of the internal circuits 16 become substantially equal to those when the threshold voltage has the typical value and when the temperature has a typical value.

When the threshold voltage of a transistor formed in the semiconductor integrated circuit exceeds the typical value, or when the ambient temperature rises while the semiconductor integrated circuit is in operation, the currents I5 of the nMOS transistors NM5 in the correcting circuits 14C decrease, so that the currents supplied to the internal circuits 16 increase. Consequently, the operating speed of the internal circuits 16 becomes faster, resulting in the increase in the current consumption. As a result, the operating speed and the current consumption of the internal circuits 16 become substantially equal to those when the threshold voltage has the typical value and when the temperature has the typical value.

The same effects as those of the above-described first embodiment can be obtained also in this embodiment. Further, in this embodiment, the correcting circuits 14C are formed for the respective internal circuits 16. This makes it possible to determine according to the functions of the internal circuits 16 (16*a*, 16*b*, . . . ) whether or not each of the correcting circuits 14C is to be used. Further, it is possible to make fine adjustment of values of the currents flowing through the nMOS transistors NM5 in accordance with the operational characteristics of the internal circuits 16. As a result, the fluctuation of the operating speed of the internal circuits 16 can be prevented without fail.

Figure 14:
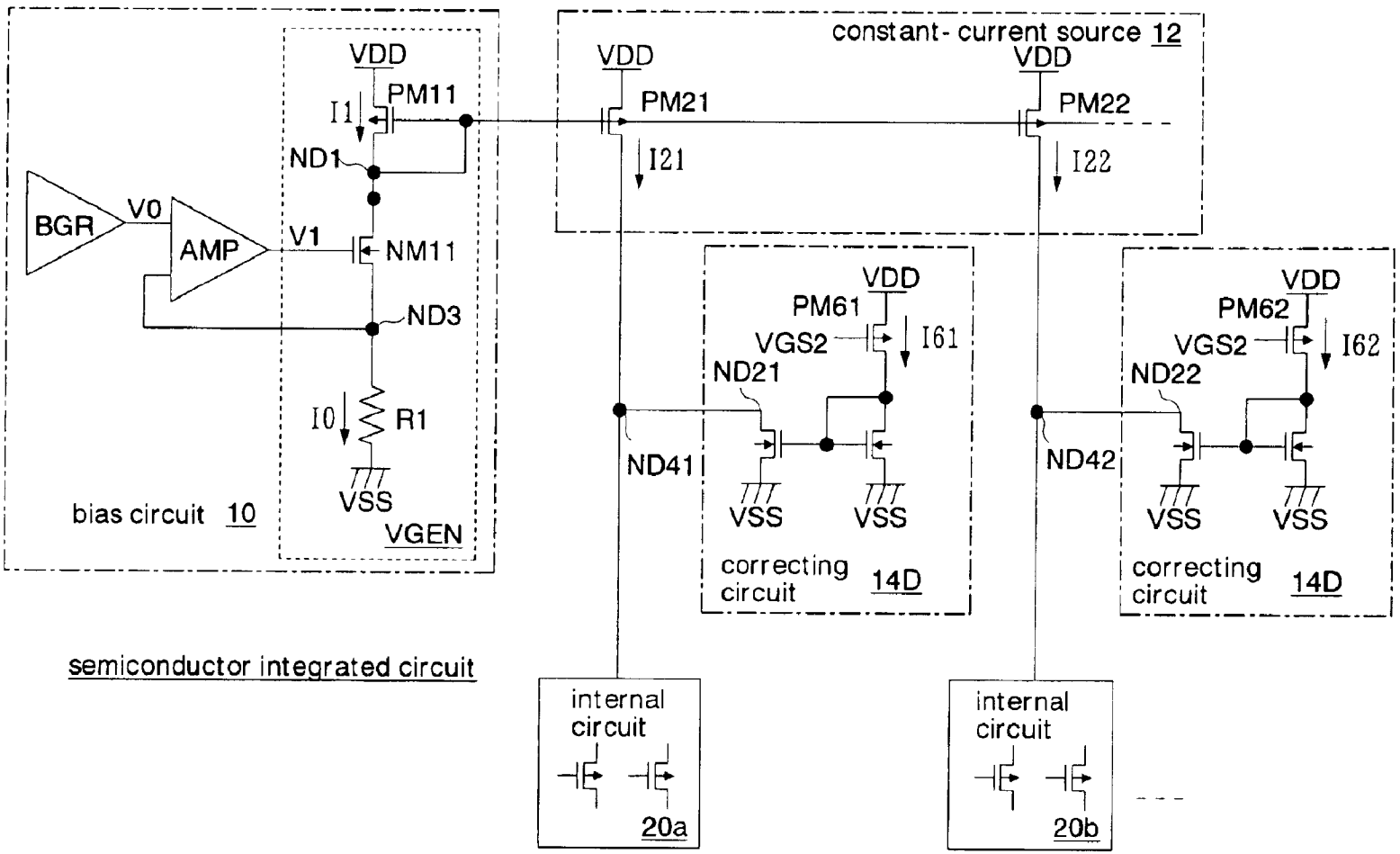
FIG. 14 is a circuit diagram showing a fifth embodiment of the semiconductor integrated circuit of the present invention.

FIG. 14 shows a fifth embodiment of the semiconductor integrated circuit of the present invention. The same reference numerals and symbols are used to designate the same components as those explained in the first, second, and fourth embodiments, and detailed explanation thereof will be omitted.

In this embodiment, a plurality of correcting circuits 14D are connected not to a bias circuit 10 but to connection nodes ND4 (ND41, ND42, . . . ) between a constant-current source 12 and internal circuits 20 (20*a*, 20*b*, . . . ). The other configuration is the same as that of the second embodiment.

The correcting circuits 14D are so configured that transistors thereof have reverse polarity to that of the transistors constituting the correcting circuit 14 of the first embodiment. Specifically, each of the correcting circuits 14D has a pair of nMOS transistors constituting a current mirror circuit (second current mirror circuit) and a pMOS transistor PM6 (PM61, PM62, . . . ; correcting transistor). Gate of the pMOS transistors PM6 are connected to constant voltage lines VGS2.

The correcting circuits 14D operate similarly to the correcting circuits 14C of the fourth embodiment. Specifically, power supply currents I2 (I21, I22, . . . ) outputted from the constant-current source 12 partly flow to ground lines VSS as drain-to-source currents I6 (I61, I62, . . . ; correcting current) of the PMOS transistors PM6 (PM61, PM62, . . . ). Consequently, currents equal to the power supply currents I2 from which the currents I6 are subtracted flow to the internal circuits 20 (20*a*, 20*b*, . . . ).

The same effects as those of the above-described first and fourth embodiments can be obtained also in this embodiment.

Figure 15:
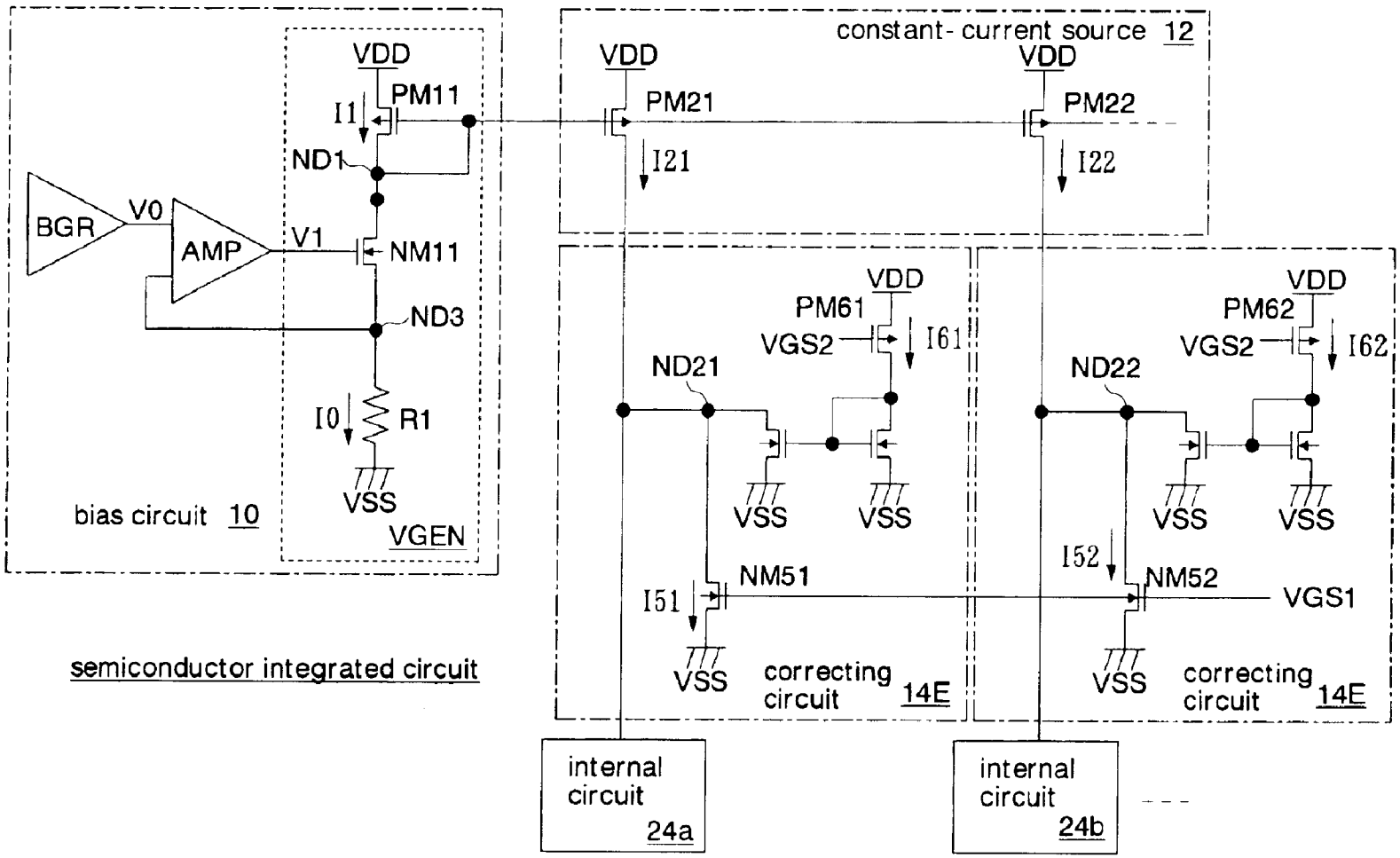
FIG. 15 is a circuit diagram showing a sixth embodiment of the semiconductor integrated circuit of the present invention.

FIG. 15 shows a sixth embodiment of the semiconductor integrated circuit of the present invention. The same reference numerals and symbols are used to designate the same components as those explained in the first embodiment, and detailed explanation thereof will be omitted.

In this embodiment, correcting circuits 14E and internal circuits 24 (24*a*, 24*b*, . . . ) are formed instead of the correcting circuits 14C and the internal circuits 16 (16*a*, 16*b*, . . . ) of the fourth embodiment. Semiconductor integrated circuit chip is formed on a silicon substrate as, for example, LCD driver, using a CMOS process. The internal circuits 24 are formed as operational amplifiers of the LCD driver. The operational amplifiers are constituted of nMOS transistors and pMOS transistors. The other configuration is the same as that of the first embodiment.

The correcting circuits 14E are constituted of the combination of the correcting circuits 14C of the fourth embodiment and the correcting circuits 14D of the fifth embodiment. Specifically, drains of nMOS transistors NM51, NM52 and drains of pMOS transistors PM61, PM62 are connected to second nodes ND21, ND22 respectively. Currents equal to the sum of currents I51, I52 of the nMOS transistors NM51, NM52 and currents I61, I62 of the pMOS transistors PM61, PM62 flow through the nodes ND21, ND22, respectively.

The same effects as those of the above-described first to fifth embodiments can be obtained also in this embodiment. Further, in this embodiment, power supply currents I21, I22 outputted by a constant-current source 12 are adjusted according to the PMOS transistors PM61, PM62 and the nMOS transistors NM51, NM52 that are different in polarity. Consequently, the operating speed of the internal circuits 24*a*, 24*b* can be kept constant also when circuits determining the operating speed are formed of pMOS transistors and nMOS transistors in the internal circuits 24*a*, 24*b*.

Figure 16:
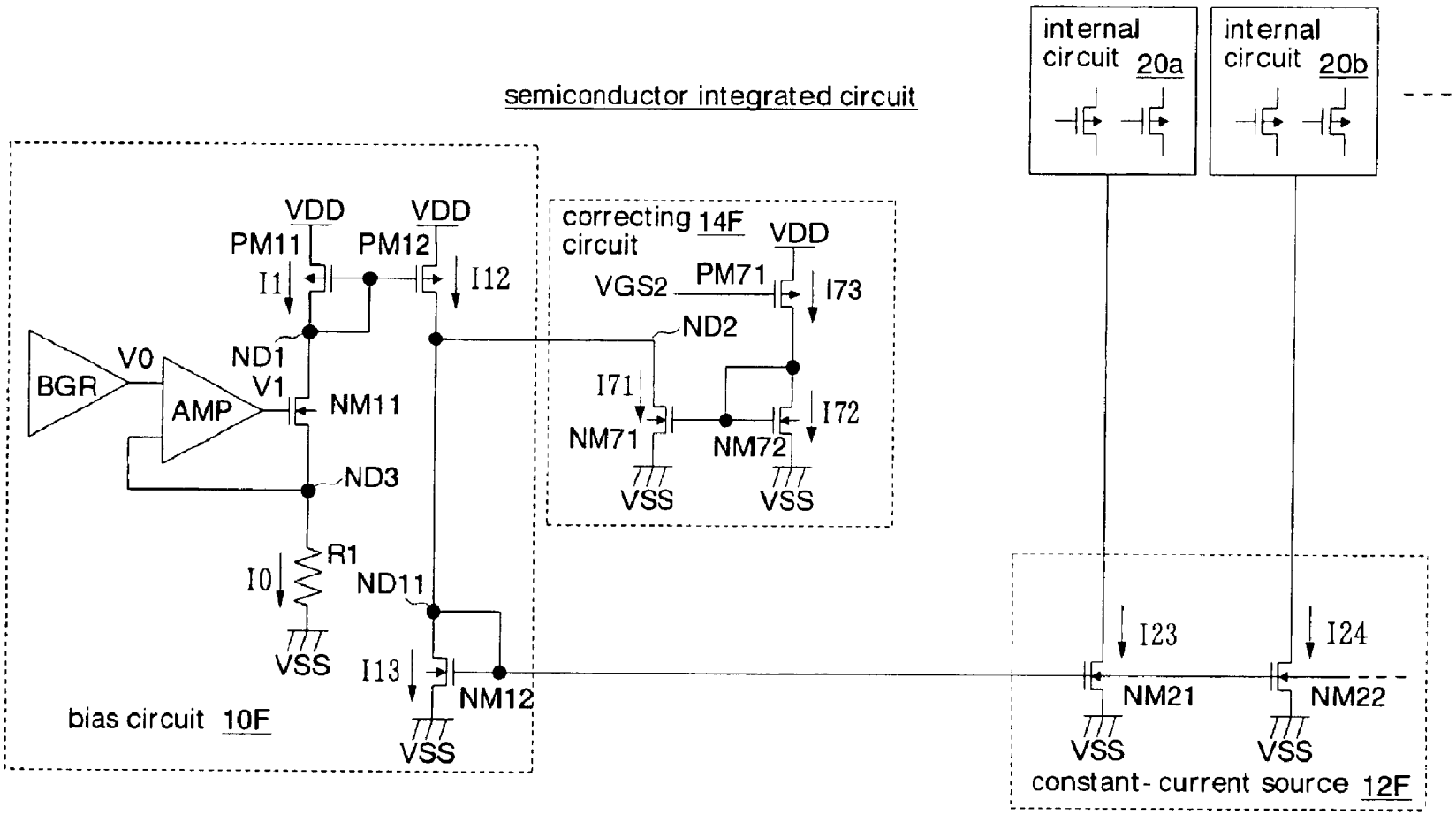
FIG. 16 is a circuit diagram showing a seventh embodiment of the semiconductor integrated circuit of the present invention.

FIG. 16 shows a seventh embodiment of the semiconductor integrated circuit of the present invention. The same reference numerals and symbols are used to designate the same components as those explained in the first embodiment, and detailed explanation thereof will be omitted.

In this embodiment, semiconductor integrated circuit chip is formed on a silicon substrate as, for example, LCD driver, using a CMOS process. The semiconductor integrated circuit has a bias circuit 10F, a constant-current source 12F, a correcting circuit 14F, and internal circuits 20 (20*a*, 20*b*, . . . ).

The bias circuit 10F is so configured that a pMOS transistor PM12 (first current source) and an nMOS transistor NM12 (load circuit) are added to the bias circuit 10 of the first embodiment. The pMOS transistor PM12 and the nMOS transistor NM12 are connected in series between a power supply line VDD and a ground line VSS. The PMOS transistor PM12 is connected to a node ND1 at its gate and is connected to a first node ND11 (first node) at its drain. The pMOS transistors PM11, PM12 constitute a current mirror circuit. A gate and a drain (first node ND11) of the nMOS transistor NM12 are connected to each other.

The constant-current source 12F has a plurality of nMOS transistors NM2 (NM21, NM22, . . . ; second current source, third transistor). The nMOS transistors NM2 are connected to ground lines VSS at sources thereof and are connected to the first node ND11 at gates thereof. Drains of the nMOS transistors NM2 are connected to the internal circuits 20*a*, 20*b*, . . . , respectively.

The nMOS transistors NM2 of the constant-current source 12F and the nMOS transistor NM12 of the bias circuit 10F constitute current mirror circuits (first current mirror circuit) respectively. Therefore, a drain-to-source current I13 of the nMOS transistor NM12 becomes equal to each of drain-to-source currents I2 (I23, I24, . . . ; power supply current) of the nMOS transistors NM2 respectively. Consequently, the currents I23, I24, . . . respectively supplied to the internal circuits 20*a*, 20*b*, . . . become equal to the current I13 flowing in the bias circuit 10.

The correcting circuit 14F is so configured that transistors thereof have reverse polarity from that of the transistors constituting the correcting circuit 14 of the first embodiment. Specifically, the correcting circuit 14F has nMOS transistors NM71, NM72 (fourth transistor) constituting a current mirror circuit (second current mirror circuit) and a pMOS transistor PM71 (correcting transistor). A gate of the pMOS transistor PM71 is connected to a constant voltage line VGS2.

In this embodiment, the current I12 outputted from the pMOS transistor PM12 partly flows to the ground line VSS via the correcting circuit 14F. Consequently, a current equal to the current I12 from which the current I71 is subtracted flows through the nMOS transistor NM12.

When the threshold voltage of a transistor formed in the semiconductor integrated circuit becomes lower than a typical value, or when the ambient temperature drops while the semiconductor integrated circuit is in operation, a current I73 of the pMOS transistor PM71 in the correcting circuit 14F increases, so that the current I13 of the nMOS transistor NM12 in the bias circuit 10F and the power supply currents I23, I24, . . . of the constant-current source 12F decrease. Consequently, the operating speed of the internal circuits 20 slows down to decrease current consumption. As a result, the operating speed and the current consumption of the internal circuits 20 become substantially equal to those when the threshold voltage has the typical value and when the temperature has a typical value.

When the threshold voltage of a transistor formed in the semiconductor integrated circuit exceeds the typical value, or when the ambient temperature rises while the semiconductor integrated circuit is in operation, the current I73 of the pMOS transistor PM71 in the correcting circuit 14F decreases, so that the current I13 of the nMOS transistor NM12 in the bias circuit 10F and the power supply currents I23, I24, . . . of the constant-current source 12F increase. As a result, the operating speed and the current consumption of the internal circuits 20 become substantially equal to those when the threshold voltage has the typical value and when the temperature has the typical value.

The same effects as those of the above-described first embodiment can be obtained also in this embodiment.

Figure 17:
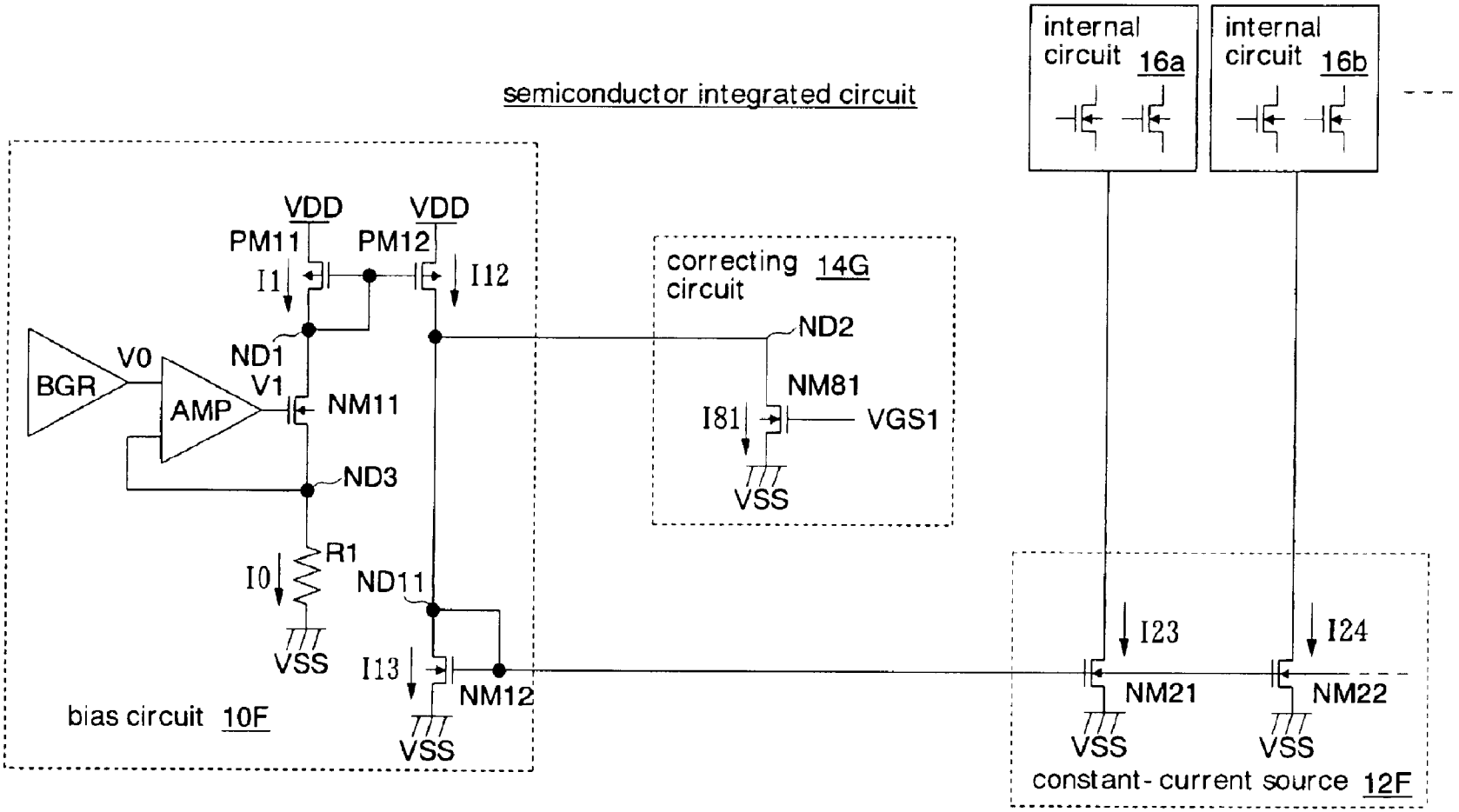
FIG. 17 is a circuit diagram showing an eighth embodiment of the semiconductor integrated circuit of the present invention.

FIG. 17 shows an eighth embodiment of the semiconductor integrated circuit of the present invention. The same reference numerals and symbols are used to designate the same components as those explained in the first, second, and seventh embodiments, and detailed explanation thereof will be omitted.

In this embodiment, a correcting circuit 14G and internal circuits 16 (16*a,* 16*b,* . . . ) are formed instead of the correcting circuit 14F and the internal circuits 20 (20*a,* 20*b,* . . . ) of the seventh embodiment. Semiconductor integrated circuit chip is formed on a silicon substrate as, for example, LCD driver, using a CMOS process. The other configuration is the same as that of the seventh embodiment.

The correcting circuit 14G is so configured that transistors thereof have reverse polarity to that of the transistors constituting the correcting circuit 14A of the second embodiment. Specifically, the correcting circuit 14G is constituted of an nMOS transistor NM81 (correcting transistor) that is connected to a ground line VSS at its source, is connected to a constant voltage line VGS1 at is gate, and is connected to a node ND2 at its drain.

The operation of this embodiment is substantially the same as that of the seventh embodiment. Specifically, when the threshold voltage of a transistor formed in the semiconductor integrated circuit becomes lower than a typical value, or when the ambient temperature drops while the semiconductor integrated circuit is in operation, a current I81 flowing through the correcting circuit 14G increases and currents I23, I24 flowing to ground lines VSS from the internal circuits 16*a,* 16*b* decrease. When the threshold voltage of a transistor formed in the semiconductor integrated circuit exceeds the typical value, or when the ambient temperature rises while the semiconductor integrated circuit is in operation, the current I81 flowing through the correcting circuit 14G decreases and the currents I23, I24 flowing to the ground lines VSS from the internal circuits 16*a,* 16*b* increase. As a result, the operating speed of the internal circuits 16*a,* 16*b* is kept substantially constant.

The same effects as those of the above-described first and second embodiments can be obtained also in this embodiment.

Figure 18:
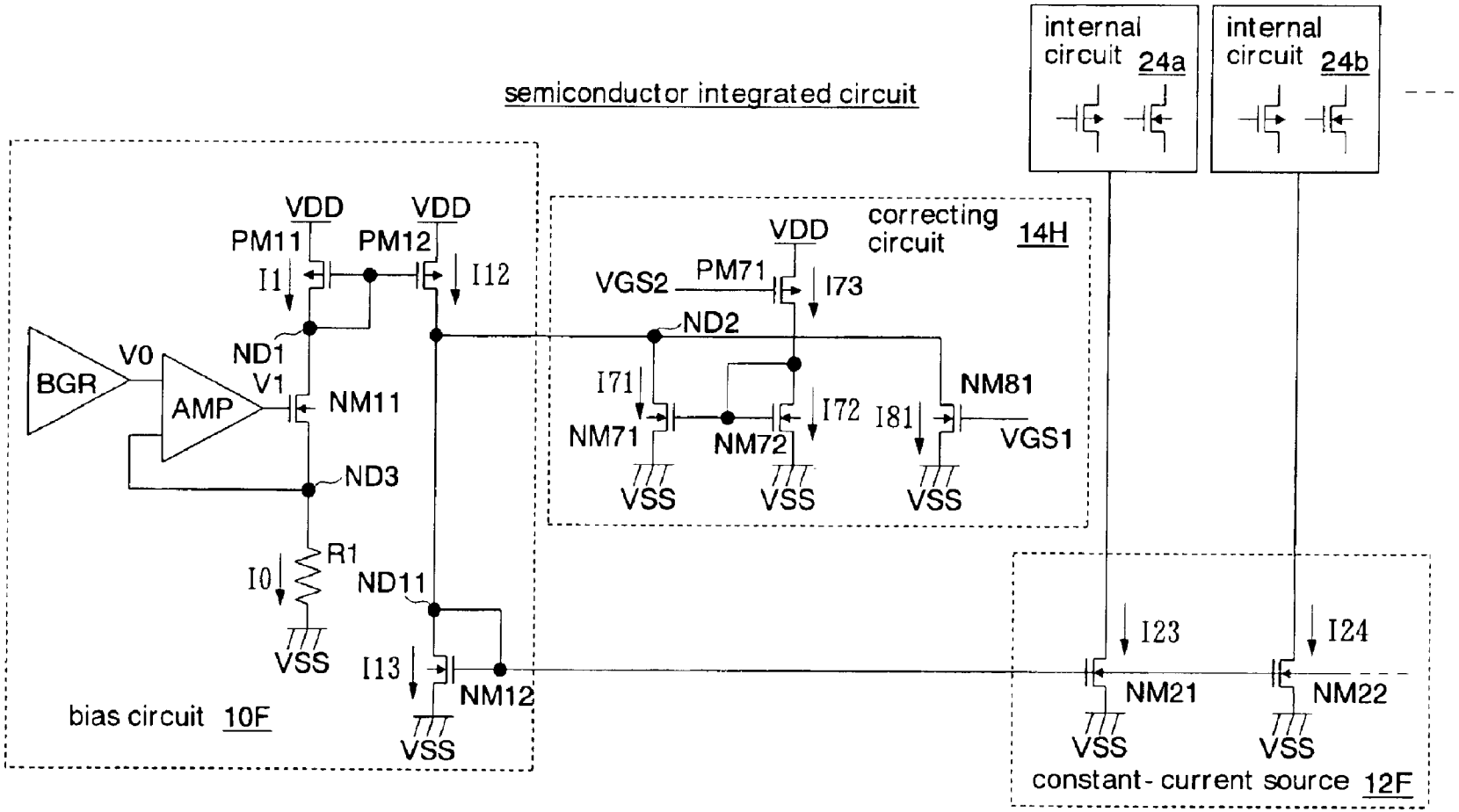
FIG. 18 is a circuit diagram showing a ninth embodiment of the semiconductor integrated circuit of the present invention.

FIG. 18 shows a ninth embodiment of the semiconductor integrated circuit of the present invention. The same reference numerals and symbols are used to designate the same components as those explained in the first, third, and seventh embodiments, and detailed explanation thereof will be omitted.

In this embodiment, a correcting circuit 14H and internal circuits 24 (24*a,* 24*b,* . . . ) are formed instead of the correcting circuit 14F and the internal circuits 20 (20*a,* 20*b,* . . . ) of the seventh embodiment. Semiconductor integrated circuit chip is formed on a silicon substrate as, for example, LCD driver, using a CMOS process. The other configuration is the same as that of the seventh embodiment.

The correcting circuit 14H is constituted of the combination of the correcting circuit 14F of the seventh embodiment and the correcting circuit 14G of the eighth embodiment. In other words, the correcting circuit 14H is so configured that transistors thereof have reverse polarity to that of the transistors constituting the correcting circuit 14B of the third embodiment.

The same effects as those of the above-described first and third embodiments can be obtained also in this embodiment.

Figure 19:
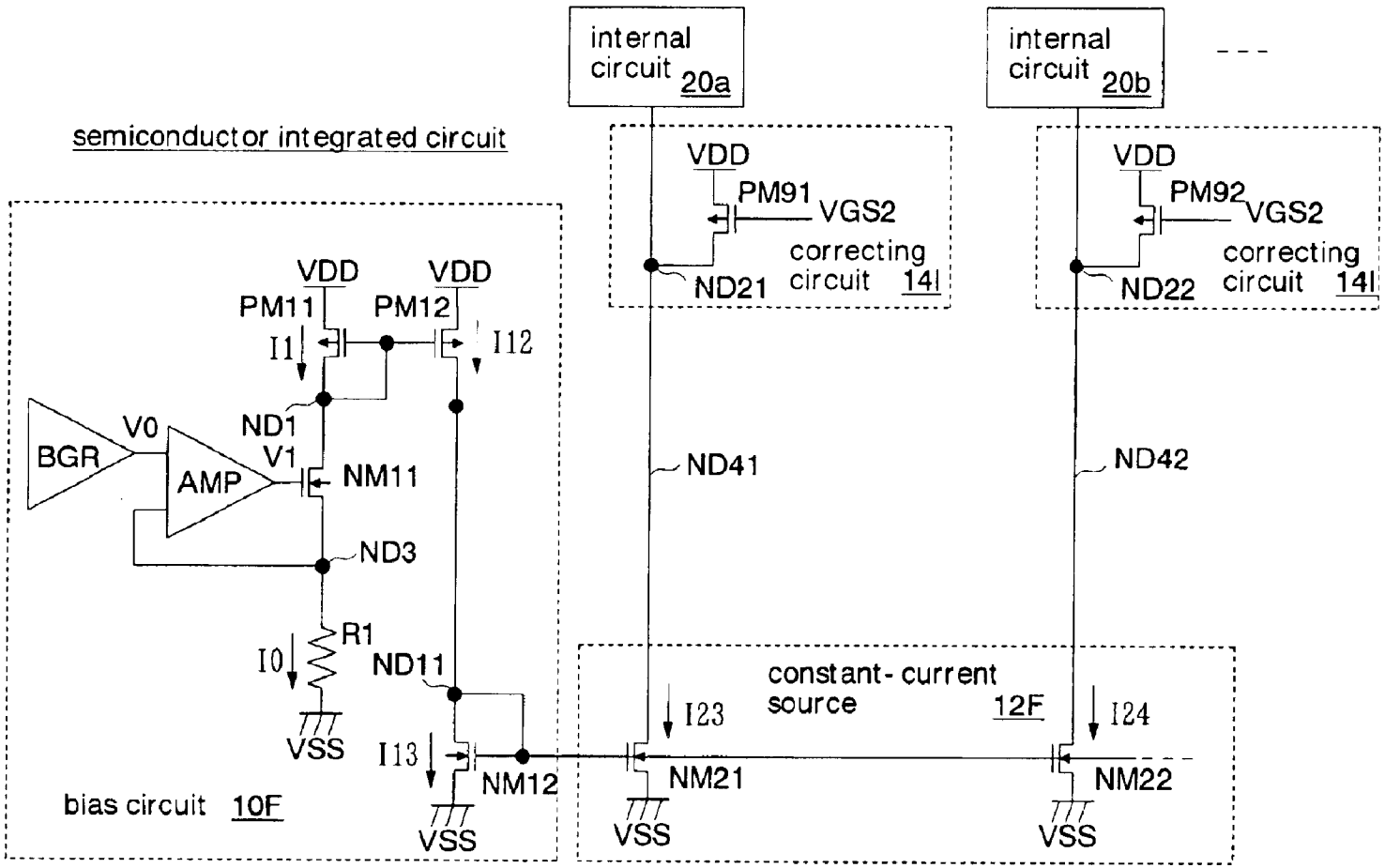
FIG. 19 is a circuit diagram showing a tenth embodiment of the semiconductor integrated circuit of the present invention.

FIG. 19 shows a tenth embodiment of the semiconductor integrated circuit of the present invention. The same reference numerals and symbols are used to designate the same components as those explained in the first and seventh embodiments, and detailed explanation thereof will be omitted.

In this embodiment, a plurality of correcting circuits 141 are connected not to a bias circuit 10F but to connecting nodes ND4 (ND41, ND42, . . . ) between a constant-current source 12F and internal circuits 20 (20*a,* 20*b,* . . . ). The other configuration is the same as that of the seventh embodiment.

The correcting circuits 141 are so configured that transistors thereof have reverse polarity to that of the transistors of the correcting circuits 14C of the fourth embodiment. Specifically, the correcting circuits 141 are constituted of pMOS transistors PM9 (PM91, PM92, . . . ; correcting transistor) that are connected to the nodes ND41, ND42 respectively at drains thereof.

In this embodiment, the sum of currents flowing from the internal circuits 20 and currents flowing from the correcting circuits 141 flow to a constant-current source 12F.

When the threshold voltage of a transistor formed in the semiconductor integrated circuit becomes lower than a typical value, or when the ambient temperature drops while the semiconductor integrated circuit is in operation, currents of the pMOS transistors PM9 in the correcting circuits 141 increase, so that currents outputted from the internal circuits 20 decrease. Consequently, the operating speed of the internal circuits 20 slows down to decrease current consumption. As a result, the operating speed and the current consumption of the internal circuits 20 become substantially equal to those when the threshold voltage has the typical value and when the ambient temperature has a typical value.

When the threshold voltage of a transistor formed in the semiconductor integrated circuit exceeds the typical value, or when the ambient temperature rises while the semiconductor integrated circuit is in operation, the currents of the pMOS transistors PM9 in the correcting circuits 141 decrease, so that the currents outputted from the internal circuits 20 increase. Consequently, the operating speed of the internal circuits 20 becomes faster to increase the current consumption. As a result, the operating speed and the current consumption of the internal circuits 20 become substantially equal to those when the threshold voltage has the typical value and when the temperature has the typical value.

The same effects as those of the above-described first and fourth embodiments can be obtained also in this embodiment.

Figure 20:
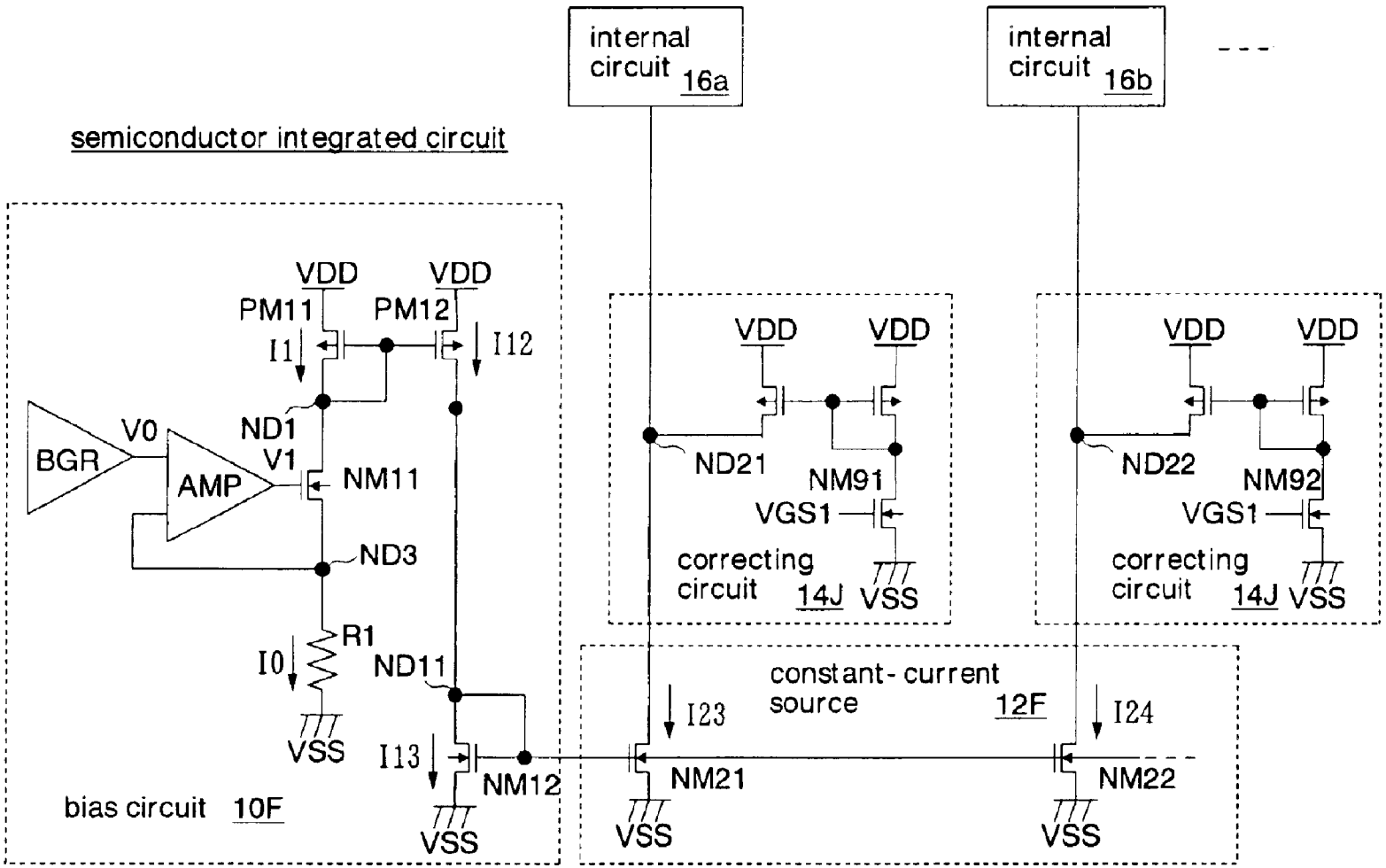
FIG. 20 is a circuit diagram showing an eleventh embodiment of the semiconductor integrated circuit of the present invention.

FIG. 20 shows an eleventh embodiment of the semiconductor integrated circuit of the present invention. The same reference numerals and symbols are used to designate the same components as those explained in the first and seventh embodiments, and detailed explanation thereof will be omitted.

In this embodiment, correcting circuits 14J and internal circuits 16 (16*a,* 16*b,* . . . ) are formed instead of the correcting circuits 14I and the internal circuits 20 (20*a,* 20*b,* . . . ) of the tenth embodiment. The other configuration is the same as that of the seventh embodiment.

The correcting circuits 14J are so configured that transistors thereof have reverse polarity to that of the transistors of the correcting circuits 14D of the fifth embodiment. Specifically, each of the correcting circuits 14J has a pair of pMOS transistors constituting a current mirror circuit (second current mirror circuit) and an nMOS transistor NM9 (NM91, NM92, . . . ; correcting transistor). The nMOS transistors NM9 are connected to constant-voltage lines VGS1 at gates thereof.

The correcting circuits 14J operate similarly to the correcting circuits 14C of the tenth embodiment. Further, currents equal to the sum of currents flowing from the internal circuits 16 and currents flowing from the correcting circuits 14J flow to a constant-current source 12F.

The same effects as those of the above-described first and fifth embodiments can be obtained also in this embodiment.

Figure 21:
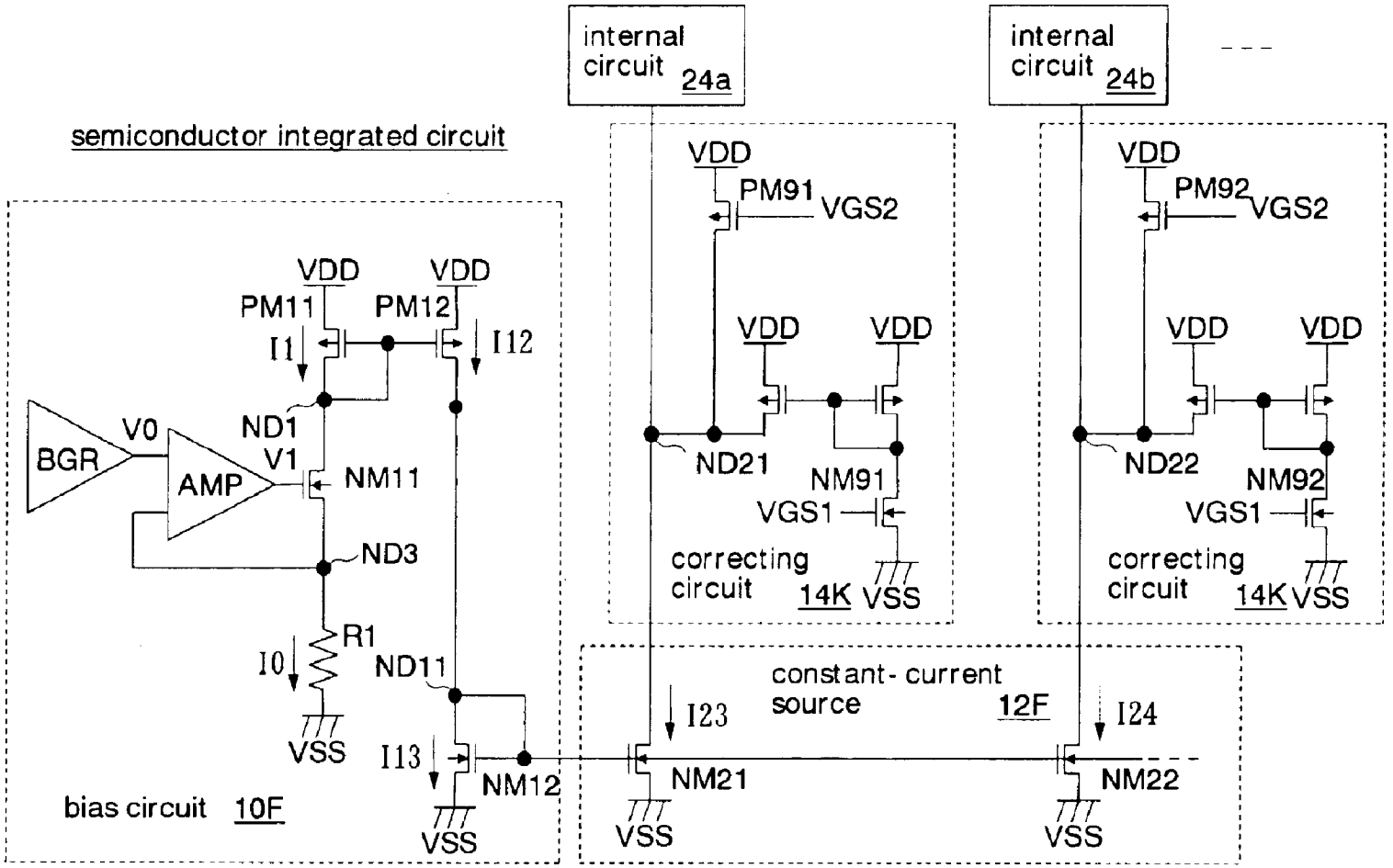
FIG. 21 is a circuit diagram showing a twelfth embodiment of the semiconductor integrated circuit of the present invention.

FIG. 21 shows a twelfth embodiment of the semiconductor integrated circuit of the present invention. The same reference numerals and symbols are used to designate the same components as those explained in the first embodiment, and detailed explanation thereof will be omitted.

In this embodiment, correcting circuits 14K and internal circuits 24 (24*a*, 24*b*, . . . ) are formed instead of the correcting circuits 141 and the internal circuits 20 (20*a*, 20*b*, . . . ) of the tenth embodiment. The other configuration is the same as that of the seventh embodiment.

The correcting circuits 14K are so configured that transistors thereof have reverse polarity to that of the transistors of the correcting circuits 14E of the sixth embodiment. Specifically, the correcting circuits 14K are constituted of the combination of the correcting circuits 14I of the tenth embodiment and the correcting circuits 14J of the eleventh embodiment.

The same effects as those of the above-described first and sixth embodiments can be obtained also in this embodiment.

The invention is not limited to the above embodiments and various modifications may be made without departing from the spirit and scope of the invention. Any improvement may be made in part or all of the components.

What is claimed is:

1. A semiconductor integrated circuit comprising:

a bias circuit that has a first current source for generating a first current and a load circuit connected in series with the first current source, and that generates a first voltage at a first node that is a connecting node between the first current source and the load circuit;

a second current source that generates a power supply current in accordance with the first voltage;

an internal circuit that has a plurality of first transistors and is connected to said second current source in order to operate the first transistors; and a correcting circuit that includes a correcting transistor receiving a constant voltage at a gate, and that generates, in accordance with the constant voltage, a correcting current at a second node electrically connected to a drain of the correcting transistor, the second node being electrically connected to the first node, wherein:

the drain of the correcting transistor is connected to each gate of a pair of second transistors forming a first current mirror circuit; and a drain of one of the second transistors that is not connected to the correcting transistor is connected to the second node.

2. A semiconductor integrated circuit comprising:

a bias circuit that has a first current source for generating a first current and a load circuit connected in series with the first current source, and that generates a first voltage at a first node that is a connecting node between the first current source and the load circuit;

a second current source that generates a power supply current in accordance with the first voltage;

an internal circuit that has a plurality of first transistors and is connected to said second current source in order to operate the first transistors; and a correcting circuit that includes a correcting transistor receiving a constant voltage at a gate, and that generates, in accordance with the constant voltage, a correcting current at a second node electrically connected to a drain of the correcting transistor, the second node being electrically connected to the first node, wherein:

said bias circuit has a reference voltage generator that has a threshold voltage compensating function for a variation of a threshold voltage of each of the first transistors formed in said internal circuit, and a temperature compensating function for a temperature variation;

said reference voltage generator generating a constant reference voltage independently of the temperature variation and the variation of the threshold voltage; and said bias circuit generates the first voltage in accordance with the reference voltage.

3. The semiconductor integrated circuit according to claim 2, wherein the reference voltage generator is a band-gap reference.

4. The semiconductor integrated circuit according to claim 2, wherein the correcting transistor is an nMOS transistor.

5. The semiconductor integrated circuit according to claim 2, wherein the correcting transistor is a pMOS transistor.

6. The semiconductor integrated circuit according to claim 2, wherein:

said first current source and said second current source have a third transistor and a fourth transistor respectively whose gates are connected to the first node; and the third transistor and the fourth transistor constitute a second current mirror circuit.

7. The semiconductor integrated circuit according to claim 2, wherein a drain of the correcting transistor is directly connected to the second node.

8. The semiconductor integrated circuit according to claim 2, wherein:

a drain of the correcting transistor is connected to each gate of a pair of fourth transistors constituting a second current mirror circuit; and a drain of one of the fourth transistors that is not connected to the correcting transistor is connected to the second node.

* * * * *